US009433905B2

(12) United States Patent
Dissinger et al.

(10) Patent No.: US 9,433,905 B2
(45) Date of Patent: Sep. 6, 2016

(54) LOW PROFILE CASCADE AERATOR

(71) Applicant: Jim Myers & Sons, Inc., Pineville, NC (US)

(72) Inventors: Kerry Edward Dissinger, Fort Mill, SC (US); Timothy Webster Gunnels, Fort Mill, SC (US)

(73) Assignee: Jim Myers & Sons, Inc., Pineville, NC (US)

( * ) Notice: Subject to any disclaimer, the term of this patent is extended or adjusted under 35 U.S.C. 154(b) by 268 days.

(21) Appl. No.: 14/183,861

(22) Filed: Feb. 19, 2014

(65) Prior Publication Data

US 2014/0312515 A1 Oct. 23, 2014

Related U.S. Application Data

(60) Provisional application No. 61/766,969, filed on Feb. 20, 2013.

(51) Int. Cl.
*B01F 3/04* (2006.01)

(52) U.S. Cl.
CPC ..... *B01F 3/04744* (2013.01)

(58) Field of Classification Search
CPC ..... B01F 3/04744
USPC ..... 261/108, 114.1, 114.3, 114.4, 114.5, 261/119.1
See application file for complete search history.

(56) References Cited

U.S. PATENT DOCUMENTS 337,446 A * 3/1886 Scott et al. ..... B01D 3/20 261/114.1
829,700 A * 8/1906 Drees ..... F28F 25/082 261/111
960,223 A * 5/1910 Guillaume ..... B01D 3/008 261/110
2,677,657 A * 5/1954 Jenks ..... C02F 3/121 210/151
3,729,179 A * 4/1973 Keller ..... B01D 3/20 261/114.1
4,516,528 A * 5/1985 Jones ..... E02B 13/00 119/226
4,547,326 A * 10/1985 Weiler ..... B01D 3/20 261/114.1

(Continued)

FOREIGN PATENT DOCUMENTS

JP 3285884 * 3/2002

OTHER PUBLICATIONS

Gourley, H. J. F., et al.; "*The Flow of Water over Sharp-Edged Notches and Weirs;*" ICE Publishing Journal—Minutes of the Proceedings, vol. 200, No. 1915; dated Jan. 1915; pp. 388-408; retrieved on Apr. 9, 2014.

(Continued)

*Primary Examiner* — Charles Bushey
(74) *Attorney, Agent, or Firm* — Alston & Bird LLP

(57) ABSTRACT

A cascade aerator comprising a plurality of longitudinal channels that receive a fluid therethrough. The longitudinal channels are in fluid communication with a plurality of flow control gates, such that a first number of flow control gates are in fluid communication with a first longitudinal channel and a second number of flow control gates are in fluid communication with a second longitudinal channel. The first number of flow control gates may define a crest height that is lower, along a vertical direction, than a crest height defined by the second number of flow control gates. The flow control gates may define a crest length proximate a crest of the flow control gate and a nappe length defined proximate a first height above the crest. The nappe length may be greater than the crest length. The aerator may have a plurality of low head baffles.

28 Claims, 20 Drawing Sheets

(56) References Cited

U.S. PATENT DOCUMENTS

| | | | | |
|---|---|---|---|---|
| 5,259,996 | A | 11/1993 | Morgan | |
| 6,923,852 | B2 * | 8/2005 | Vrotsos | B01D 53/504 261/113 |
| 9,192,895 | B2 * | 11/2015 | Meurer | B01F 3/04744 |

OTHER PUBLICATIONS

"*Approval Submittal—Low Profile Cascade Aerator—ETEX Max Foote Construction Co., Inc.—South Woolmarket WRF*, Gulfport, MS;" JMS Project 10-1004; JMS—Jim Myers & Sons, Inc.; dated Feb. 2010.

"*Chapter 1—Basic Hydraulic Principles;*" Haestad Methods, Inc. pp. 1-30; dated 2002.

"*Cipolletti Sharp-Crested Weir;*" originally retrieved on May 16, 2007 from <http://docs.bentley.com/en/HMFlowMaster/FlowMasterHelp-06-48.html>; presently retrieved on May 21, 2014 from <http://web.archive.org/web/20070516211130/http://docs.bentley.com/en/HMFlowMaster/FlowMasterHelp-06-48.html>.

"*Design data for Low Profile Cascade Aerator;*" Engineering Calculations for Camden, SC Project; JMS—Jim Myers & Sons, Inc.; dated Jul. 19, 2010.

"*Low-Profile Cascade Aerators: The Most Efficient and Economical Method for Post Aeration*;" JMS—Jim Myers & Sons, Inc.; dated Jun. 1, 2010; retrieved on May 21, 2014 from <http://www.myersequipment.com/jms_lpca.html>.

"*Low-Profile Cascade Aerators—Post Aeration Equipment;*" Powerpoint; Bar Environmental, Inc.; dated Sep. 15, 2009; retrieved on May 21, 2014 from <http://www.bar-enviro.com/UserFiles/File/LPCA_PwptPresentationinWITHNOTESADOBEMaster09-15-09.pdf.>.

"*JMS Low-Profile Cascade Aerators:*" originally retrieved from on Jun. 21, 2012 <http://www.myersequipment.com/jms_lpca.html>; presently retrieved on May 21, 2014 from <http://web.archive.org/web/20120621182608/http://www.myersequipment.com/jms_lpca.html>.

Part No. 1004-F04; Description: PL 11ga×11 5/16"×22 5/16"; JMS—Jim Myers & Sons, Inc.; dated Jul. 1, 2010.

"*Section 18610—Low Profile Cascade Aerator* (*LPCA*);" pp. 1-7; May 2014.

"*Weirs;*" Hydraulics; originally retrieved on Mar. 10, 2007 from <http://www.engineeringcivil.com/weirs.html>; presently retrieved on May 21, 2014 from <http://web.archive.org/web/20071214184545/http://www.engineeringcivil.com/weirs.html>.

* cited by examiner 4.5″ (BASE) X 1″ (TOP)
TAPERED OPENING
(5″ WIDTH AT THE TOP)

4" (BASE) X 1" (TOP)
TAPERED OPENING
(5" WIDTH AT THE TOP)

3.5" (BASE) X 1" (TOP)
TAPERED OPENING
(5" WIDTH AT THE TOP)

| H (IN) | Q (STD) | Q (4.5 X 1) | Q (4 X 1) | Q (3.5 X 1) | Q (3 X 1) | Q (STD) | Q (4.5 X 1) | Q (4 X 1) | Q (3.5 X 1) | Q (3 X 1) |
|---|---|---|---|---|---|---|---|---|---|---|
| | GALLONS/DAY | | | | | % OF STANDARD | | | | |
| 0.5 | 6892.5 | 6931.6 | 6190.7 | 5452.2 | 4716.6 | 100.0% | 100.6% | 89.8% | 79.1% | 68.4% |
| 1 | 19093.8 | 19310.4 | 17366.7 | 15431.1 | 13505.6 | 100.0% | 101.1% | 91.0% | 80.8% | 70.7% |
| 1.5 | 34653.5 | 35243.0 | 31913.2 | 28600.2 | 25309.1 | 100.0% | 101.7% | 92.1% | 82.5% | 73.0% |
| 2 | 52894.0 | 54093.9 | 49313.1 | 44561.5 | 39848.8 | 100.0% | 102.3% | 93.2% | 84.2% | 75.3% |
| 2.5 | 73428.4 | 75510.6 | 69292.6 | 63120.3 | 57009.3 | 100.0% | 102.8% | 94.4% | 86.0% | 77.6% |
| 3 | 95997.7 | 99264.2 | 91682.7 | 84167.3 | 76742.0 | 100.0% | 103.4% | 95.5% | 87.7% | 79.9% |
| 3.5 | 120412.8 | 125192.9 | 116370.2 | 107638.3 | 99032.0 | 100.0% | 104.0% | 96.6% | 89.4% | 82.2% |
| 4 | 146528.0 | 153175.9 | 143275.5 | 133495.6 | 123883.5 | 100.0% | 104.5% | 97.8% | 91.1% | 84.5% |
| 4.5 | 174226.8 | 183119.4 | 172341.4 | 161718.4 | 151312.8 | 100.0% | 105.1% | 98.9% | 92.8% | 86.8% |
| 5 | 203412.9 | 214948.7 | 203525.6 | 192297.1 | 181343.4 | 100.0% | 105.7% | 100.1% | 94.5% | 89.2% |
| 5.5 | 234005.3 | 248603.1 | 236796.9 | 225230.4 | 214004.0 | 100.0% | 106.2% | 101.2% | 96.3% | 91.5% |
| 6 | 265934.6 | 284032.5 | 272132.3 | 260522.5 | 249326.5 | 100.0% | 106.8% | 102.3% | 98.0% | 93.8% |
| 6.5 | 299140.4 | 321194.6 | 309514.9 | 298182.1 | 287345.5 | 100.0% | 107.4% | 103.5% | 99.7% | 96.1% |
| 7 | 333569.7 | 360053.9 | 348932.8 | 338221.0 | 328096.7 | 100.0% | 107.9% | 104.6% | 101.4% | 98.4% |

FIG. 7

| CHANNEL 1 | | | | CHANNEL 2 WITH 3" HEIGHT DIFFERENCE | | | | TOTAL FLOW | % CHAN 1 | % CHAN 2 |
|---|---|---|---|---|---|---|---|---|---|---|
| H (IN) | H (FT) | Q (CFS) | Q (GAL/DAY) | H (IN) | H (FT) | Q (CFS) | Q (GAL/DAY) | | | |
| 3 | 0.25 | 0.148541 | 95997.68 | 0 | 0 | 0 | 0 | 95997.68 | 100.0% | 0.0% |
| 3.1 | 0.258333 | 0.155876 | 100738.2 | 0.1 | 0.008333 | 0.001001 | 646.9824 | 101385.2 | 99.4% | 0.6% |
| 3.2 | 0.266667 | 0.163323 | 105551.1 | 0.2 | 0.016667 | 0.002773 | 1792.283 | 107343.4 | 98.3% | 1.7% |
| 3.3 | 0.275 | 0.170881 | 110435.3 | 0.3 | 0.025 | 0.005033 | 3252.825 | 113688.1 | 97.1% | 2.9% |
| 3.4 | 0.283333 | 0.178546 | 115389.6 | 0.4 | 0.033333 | 0.007683 | 4965.016 | 120354.6 | 95.9% | 4.1% |
| 3.5 | 0.291667 | 0.186319 | 120412.8 | 0.5 | 0.041667 | 0.010665 | 6892.526 | 127305.3 | 94.6% | 5.4% |
| 3.6 | 0.3 | 0.194197 | 125503.9 | 0.6 | 0.05 | 0.013943 | 9011.038 | 134514.9 | 93.3% | 6.7% |
| 3.7 | 0.308333 | 0.202178 | 130661.9 | 0.7 | 0.058333 | 0.017489 | 11302.81 | 141964.7 | 92.0% | 8.0% |
| 3.8 | 0.316667 | 0.210261 | 135885.9 | 0.8 | 0.066667 | 0.021282 | 13754.18 | 149640.1 | 90.8% | 9.2% |
| 3.9 | 0.325 | 0.218445 | 141174.9 | 0.9 | 0.075 | 0.025305 | 16354.19 | 157529.1 | 89.6% | 10.4% |
| 4 | 0.333333 | 0.226728 | 146528 | 1 | 0.083333 | 0.029545 | 19093.81 | 165621.8 | 88.5% | 11.5% |

| CHANNEL 1 | | | | CHANNEL 2 WITH 3.5" HEIGHT DIFFERENCE | | | | TOTAL FLOW | % CHAN 1 | % CHAN 2 |
|---|---|---|---|---|---|---|---|---|---|---|
| H (IN) | H (FT) | Q (CFS) | Q (GAL/DAY) | H (IN) | H (FT) | Q (CFS) | Q (GAL/DAY) | | | |
| 3.5 | 0.291667 | 0.186319 | 120412.8 | 0 | 0 | 0 | 0 | 120412.8 | 100.0% | 0.0% |
| 3.6 | 0.3 | 0.194197 | 125503.9 | 0.1 | 0.008333 | 0.001001 | 646.9824 | 126150.9 | 99.5% | 0.5% |
| 3.7 | 0.308333 | 0.202178 | 130661.9 | 0.2 | 0.016667 | 0.002773 | 1792.283 | 132454.2 | 98.6% | 1.4% |
| 3.8 | 0.316667 | 0.210261 | 135885.9 | 0.3 | 0.025 | 0.005033 | 3252.825 | 139138.7 | 97.7% | 2.3% |
| 3.9 | 0.325 | 0.218445 | 141174.9 | 0.4 | 0.033333 | 0.007683 | 4965.016 | 146139.9 | 96.6% | 3.4% |
| 4.0 | 0.333333 | 0.226728 | 146528 | 0.5 | 0.041667 | 0.010665 | 6892.526 | 153420.5 | 95.5% | 4.5% |
| 4.1 | 0.341667 | 0.235109 | 151944.4 | 0.6 | 0.05 | 0.013943 | 9011.038 | 160955.5 | 94.4% | 5.6% |
| 4.2 | 0.35 | 0.243587 | 157423.3 | 0.7 | 0.058333 | 0.017489 | 11302.81 | 168726.1 | 93.3% | 6.7% |
| 4.3 | 0.358333 | 0.25216 | 162963.8 | 0.8 | 0.066667 | 0.021282 | 13754.18 | 176718 | 92.2% | 7.8% |
| 4.4 | 0.366667 | 0.260827 | 168565.2 | 0.9 | 0.075 | 0.025305 | 16354.19 | 184919.4 | 91.2% | 8.8% |
| 4.5 | 0.375 | 0.269587 | 174226.8 | 1 | 0.083333 | 0.029545 | 19093.81 | 193320.6 | 90.1% | 9.9% |

| CHANNEL 1 | | | | CHANNEL 2 WITH 4" HEIGHT DIFFERENCE | | | | TOTAL FLOW | % CHAN 1 | % CHAN 2 |
|---|---|---|---|---|---|---|---|---|---|---|
| H (IN) | H (FT) | Q (CFS) | Q (GAL/DAY) | H (IN) | H (FT) | Q (CFS) | Q (GAL/DAY) | | | |
| 4 | 0.333333 | 0.226728 | 146528 | 0 | 0 | 0 | 0 | 146528 | 100.0% | 0.0% |
| 4.1 | 0.341667 | 0.235109 | 151944.4 | 0.1 | 0.008333 | 0.001001 | 646.9824 | 152591.4 | 99.6% | 0.4% |
| 4.2 | 0.35 | 0.243587 | 157423.3 | 0.2 | 0.016667 | 0.002773 | 1792.283 | 159215.6 | 98.9% | 1.1% |
| 4.3 | 0.358333 | 0.25216 | 162963.8 | 0.3 | 0.025 | 0.005033 | 3252.825 | 166216.6 | 98.0% | 2.0% |
| 4.4 | 0.366667 | 0.260827 | 168565.2 | 0.4 | 0.033333 | 0.007683 | 4965.016 | 173530.2 | 97.1% | 2.9% |
| 4.5 | 0.375 | 0.269587 | 174226.8 | 0.5 | 0.041667 | 0.010665 | 6892.526 | 181119.3 | 96.2% | 3.8% |
| 4.6 | 0.383333 | 0.27844 | 179947.8 | 0.6 | 0.05 | 0.013943 | 9011.038 | 188958.8 | 95.2% | 4.8% |
| 4.7 | 0.391667 | 0.287383 | 185727.6 | 0.7 | 0.058333 | 0.017489 | 11302.81 | 197030.4 | 94.3% | 5.7% |
| 4.8 | 0.4 | 0.296416 | 191565.4 | 0.8 | 0.066667 | 0.021282 | 13754.18 | 205319.6 | 93.3% | 6.7% |
| 4.9 | 0.408333 | 0.305538 | 197460.7 | 0.9 | 0.075 | 0.025305 | 16354.19 | 213814.9 | 92.4% | 7.6% |
| 5.0 | 0.416667 | 0.314748 | 203412.9 | 1 | 0.083333 | 0.029545 | 19093.81 | 222506.7 | 91.4% | 8.6% |

FIG. 12

PREMISE OF DESIGN

DESIRE FLOW TO STAY IN CHANNEL 1 UNLESS NEXT CHANNEL IS A VERY SMALL PERCENTAGE OF OVERALL FLOW
USING STANDARD RECTANGULAR OPENINGS, CHANNEL 1 WILL HAVE THE STANDARD 4.5" OPENING
BUT WILL HAVE A MAX OPENING HEIGHT OF 5" TO METER FLOW AFTER H EXCEEDS 5"
CHANNEL 2 WILL HAVE STANDARD 4.5" OPENING

CHANNEL 1
RECTANGULAR OPENING WHERE B = WIDTH OF OPENING

F = 8 IN
B = 4.5 IN
T = 1.5 IN
C = 6 IN
RISE = F 8 IN
RUN = (C - T - B) /2 0
α = 0 DEGREES
α = 0 RADIANS
n = 0
L = 0.375 FEET SAME AS B

1 CFS = 646272 GAL/DAY

| H (IN) | H (FT) | Q (CFS) | Q (GAL/DAY) |
|---|---|---|---|
| 0 | 0 | 0 | 0 |
| 0.5 | 0.041667 | 0.010665 | 6892.526 |
| 1.0 | 0.083333 | 0.029545 | 19093.81 |
| 1.5 | 0.125 | 0.053621 | 34653.46 |
| 2.0 | 0.166667 | 0.081845 | 52894.02 |
| 2.5 | 0.208333 | 0.113618 | 73428.44 |
| 3.0 | 0.25 | 0.148541 | 95997.68 |
| 3.5 | 0.291667 | 0.186319 | 120412.8 |
| 4.0 | 0.333333 | 0.226728 | 146528 |
| 4.5 | 0.375 | 0.269587 | 174226.8 |
| 5.0 | 0.416667 | 0.314748 | 203412.9 |

CHANNEL 2
RECTANGULAR OPENING WHERE B = WIDTH OF OPENING

F = 8 IN
B = 4.5 IN
T = 1.5 IN
C = 6 IN
RISE = F 8 IN
RUN = (C - T - B) /2 0
α = 0 DEGREES
α = 0 RADIANS
n = 0
L = 0.375 FEET SAME AS B

1 CFS = 646272 GAL/DAY

| H (IN) | H (FT) | Q (CFS) | Q (GAL/DAY) |
|---|---|---|---|
| 0 | 0 | 0 | 0 |
| 0.5 | 0.041667 | 0.010665 | 6892.526 |
| 1.0 | 0.083333 | 0.029545 | 19093.81 |
| 1.5 | 0.125 | 0.053621 | 34653.46 |
| 2.0 | 0.166667 | 0.081845 | 52894.02 |
| 2.5 | 0.208333 | 0.113618 | 73428.44 |
| 3.0 | 0.25 | 0.148541 | 95997.68 |
| 3.5 | 0.291667 | 0.186319 | 120412.8 |
| 4.0 | 0.333333 | 0.226728 | 146528 |
| 4.5 | 0.375 | 0.269587 | 174226.8 |
| 5.0 | 0.416667 | 0.314748 | 203412.9 |
| 5.5 | 0.458333 | 0.362085 | 234005.3 |
| 6.0 | 0.5 | 0.41149 | 265934.6 |
| 6.5 | 0.541667 | 0.462871 | 299140.4 |
| 7.0 | 0.583333 | 0.516144 | 333569.7 |

FIG. 13

PREMISE OF DESIGN

DESIRE FLOW TO STAY IN CHANNEL 1 UNLESS NEXT CHANNEL IS A VERY SMALL PERCENTAGE OF OVERALL FLOW
USING STANDARD RECTANGULAR OPENINGS, CHANNEL 1 WILL HAVE A NARROWER OPENING TO DRIVE ENTRY H HIGHER SOONER AND TO METER FLOW AT HIGHER H LEVELS
CHANNEL 2 WILL HAVE STANDARD 4.5" OPENING

CHANNEL 1
RECTANGULAR OPENING WHERE B = WIDTH OF OPENING

F = 8 IN
B = 3 IN
T = 3 IN
C = 6 IN

RISE = F 8 IN
RUN = (C - T - B) /2 0

α = 0 DEGREES
α = 0 RADIANS
n = 0
L = 0.25 FEET SAME AS B

1 CFS = 646272 GAL/DAY

| H (IN) | H (FT) | Q (CFS) | Q (GAL/DAY) |
|---|---|---|---|
| 0 | 0 | 0 | 0 |
| 0.5 | 0.041667 | 0.007053 | 4557.906 |
| 1.0 | 0.083333 | 0.019537 | 12626.4 |
| 1.5 | 0.125 | 0.035458 | 22915.72 |
| 2.0 | 0.166667 | 0.054123 | 34977.88 |
| 2.5 | 0.208333 | 0.075134 | 48556.93 |
| 3.0 | 0.25 | 0.098227 | 63481.57 |
| 3.5 | 0.291667 | 0.123209 | 79626.83 |
| 4.0 | 0.333333 | 0.149931 | 96896.39 |
| 4.5 | 0.375 | 0.178273 | 115213.1 |
| 5.0 | 0.416667 | 0.208137 | 134513.3 |
| 5.5 | 0.458333 | 0.23944 | 154743.6 |
| 6.0 | 0.5 | 0.272111 | 175857.8 |
| 6.5 | 0.541667 | 0.306088 | 197816.3 |
| 7.0 | 0.583333 | 0.341317 | 220583.8 |
| 7.5 | 0.625 | 0.37775 | 244129.1 |
| 8.0 | 0.666667 | 0.415342 | 268424.2 |
| 8.5 | 0.708333 | 0.454056 | 293444 |
| 9.0 | 0.75 | 0.493856 | 319165.5 |
| 9.5 | 0.791667 | 0.534709 | 345567.7 |
| 10.0 | 0.833333 | 0.576586 | 372631.4 |
| 10.5 | 0.875 | 0.619459 | 400338.8 |
| 11.0 | 0.916667 | 0.663302 | 426673.5 |

CHANNEL 2
RECTANGULAR OPENING WHERE B = WIDTH OF OPENING

F = 8 IN
B = 4.5 IN
T = 1.5 IN
C = 6 IN

RISE = F 8 IN
RUN = (C - T - B) /2 0

α = 0 DEGREES
α = 0 RADIANS
n = 0
L = 0.375 FEET SAME AS B

1 CFS = 646272 GAL/DAY

| H (IN) | H (FT) | Q (CFS) | Q (GAL/DAY) |
|---|---|---|---|
| 0 | 0 | 0 | 0 |
| 0.5 | 0.041667 | 0.010665 | 6892.526 |
| 1.0 | 0.083333 | 0.029545 | 19093.81 |
| 1.5 | 0.125 | 0.053621 | 34653.46 |
| 2.0 | 0.166667 | 0.081845 | 52894.02 |
| 2.5 | 0.208333 | 0.113618 | 73428.44 |
| 3.0 | 0.25 | 0.148541 | 95997.68 |
| 3.5 | 0.291667 | 0.186319 | 120412.8 |
| 4.0 | 0.333333 | 0.226728 | 146528 |
| 4.5 | 0.375 | 0.269587 | 174226.8 |
| 5.0 | 0.416667 | 0.314748 | 203412.9 |
| 5.5 | 0.458333 | 0.362085 | 234005.3 |
| 6.0 | 0.5 | 0.41149 | 265934.6 |
| 6.5 | 0.541667 | 0.462871 | 299140.4 |
| 7.0 | 0.583333 | 0.516144 | 333569.7 |

FIG. 14

| CHANNEL 1 | | | | CHANNEL 2 WITH 3" HEIGHT DIFFERENCE | | | | TOTAL FLOW | % CHAN 1 | % CHAN 2 |
|---|---|---|---|---|---|---|---|---|---|---|
| H (IN) | H (FT) | Q (CFS) | Q (GAL/DAY) | H (IN) | H (FT) | Q (CFS) | Q (GAL/DAY) | | | |
| 3 | 0.25 | 0.098227 | 63481.57 | 0 | 0 | 0 | 0 | 63481.57 | 100.0% | 0.0% |
| 3.1 | 0.258333 | 0.103078 | 66616.39 | 0.1 | 0.008333 | 0.001001 | 646.9824 | 67263.37 | 99.0% | 1.0% |
| 3.2 | 0.266667 | 0.108003 | 69799.11 | 0.2 | 0.016667 | 0.002773 | 1792.283 | 71591.39 | 97.5% | 2.5% |
| 3.3 | 0.275 | 0.113 | 73028.92 | 0.3 | 0.025 | 0.005033 | 3252.825 | 76281.75 | 95.7% | 4.3% |
| 3.4 | 0.283333 | 0.11807 | 76305.07 | 0.4 | 0.033333 | 0.007683 | 4965.016 | 81270.09 | 93.9% | 6.1% |
| 3.5 | 0.291667 | 0.123209 | 79626.83 | 0.5 | 0.041667 | 0.010665 | 6892.526 | 86519.36 | 92.0% | 8.0% |
| 3.6 | 0.3 | 0.128419 | 82993.5 | 0.6 | 0.05 | 0.013943 | 9011.038 | 92004.54 | 90.2% | 9.8% |
| 3.7 | 0.308333 | 0.133697 | 86404.42 | 0.7 | 0.058333 | 0.017489 | 11302.81 | 97707.23 | 88.4% | 11.6% |
| 3.8 | 0.316667 | 0.139042 | 89858.94 | 0.8 | 0.066667 | 0.021282 | 13754.18 | 103613.1 | 86.7% | 13.3% |
| 3.9 | 0.325 | 0.144454 | 93356.46 | 0.9 | 0.075 | 0.025305 | 16354.19 | 109710.6 | 85.1% | 14.9% |
| 4 | 0.333333 | 0.149931 | 96896.39 | 1 | 0.083333 | 0.029545 | 19093.81 | 115990.2 | 83.5% | 16.5% |

| CHANNEL 1 | | | | CHANNEL 2 WITH 3.5" HEIGHT DIFFERENCE | | | | TOTAL FLOW | % CHAN 1 | % CHAN 2 |
|---|---|---|---|---|---|---|---|---|---|---|
| H (IN) | H (FT) | Q (CFS) | Q (GAL/DAY) | H (IN) | H (FT) | Q (CFS) | Q (GAL/DAY) | | | |
| 3.5 | 0.291667 | 0.123209 | 79626.83 | 0 | 0 | 0 | 0 | 79262.83 | 100.0% | 0.0% |
| 3.6 | 0.3 | 0.128419 | 82993.5 | 0.1 | 0.008333 | 0.001001 | 646.9824 | 83640.48 | 99.2% | 0.8% |
| 3.7 | 0.308333 | 0.133697 | 86404.42 | 0.2 | 0.016667 | 0.002773 | 1792.283 | 88196.7 | 98.0% | 2.0% |
| 3.8 | 0.316667 | 0.139042 | 89858.94 | 0.3 | 0.025 | 0.005033 | 3252.825 | 93111.77 | 96.5% | 3.5% |
| 3.9 | 0.325 | 0.144454 | 93356.46 | 0.4 | 0.033333 | 0.007683 | 4965.016 | 98321.48 | 95.0% | 5.0% |
| 4.0 | 0.333333 | 0.149931 | 96896.39 | 0.5 | 0.041667 | 0.010665 | 6892.526 | 103788.9 | 93.4% | 6.6% |
| 4.1 | 0.341667 | 0.155473 | 100478.2 | 0.6 | 0.05 | 0.013943 | 9011.038 | 109489.2 | 91.8% | 8.2% |
| 4.2 | 0.35 | 0.16108 | 104101.2 | 0.7 | 0.058333 | 0.017489 | 11302.81 | 115404 | 90.2% | 9.8% |
| 4.3 | 0.358333 | 0.166749 | 107765.1 | 0.8 | 0.066667 | 0.021282 | 13754.18 | 121519.3 | 88.7% | 11.3% |
| 4.4 | 0.366667 | 0.17248 | 111469.2 | 0.9 | 0.075 | 0.025305 | 16354.19 | 127823.4 | 87.2% | 12.8% |
| 4.5 | 0.375 | 0.178273 | 115213.1 | 1 | 0.083333 | 0.029545 | 19093.81 | 134306.9 | 85.8% | 14.2% |

| CHANNEL 1 | | | | CHANNEL 2 WITH 4" HEIGHT DIFFERENCE | | | | TOTAL FLOW | % CHAN 1 | % CHAN 2 |
|---|---|---|---|---|---|---|---|---|---|---|
| H (IN) | H (FT) | Q (CFS) | Q (GAL/DAY) | H (IN) | H (FT) | Q (CFS) | Q (GAL/DAY) | | | |
| 4 | 0.333333 | 0.149931 | 96896.39 | 0 | 0 | 0 | 0 | 96896.39 | 100.0% | 0.0% |
| 4.1 | 0.341667 | 0.155473 | 100478.2 | 0.1 | 0.008333 | 0.001001 | 646.9824 | 101125.1 | 99.4% | 0.6% |
| 4.2 | 0.35 | 0.16108 | 104101.2 | 0.2 | 0.016667 | 0.002773 | 1792.283 | 105893.5 | 98.3% | 1.7% |
| 4.3 | 0.358333 | 0.166749 | 107765.1 | 0.3 | 0.025 | 0.005033 | 3252.825 | 111017.9 | 97.1% | 2.9% |
| 4.4 | 0.366667 | 0.17248 | 111469.2 | 0.4 | 0.033333 | 0.007683 | 4965.016 | 116434.2 | 95.7% | 4.3% |
| 4.5 | 0.375 | 0.178273 | 115213.1 | 0.5 | 0.041667 | 0.010665 | 6892.526 | 122105.6 | 94.4% | 5.6% |
| 4.6 | 0.383333 | 0.184127 | 118996.3 | 0.6 | 0.05 | 0.013943 | 9011.038 | 128007.3 | 93.0% | 7.0% |
| 4.7 | 0.391667 | 0.190041 | 122818.4 | 0.7 | 0.058333 | 0.017489 | 11302.81 | 134121.2 | 91.6% | 8.4% |
| 4.8 | 0.4 | 0.196015 | 126678.8 | 0.8 | 0.066667 | 0.021282 | 13754.18 | 140433 | 90.2% | 9.8% |
| 4.9 | 0.408333 | 0.202047 | 130577.3 | 0.9 | 0.075 | 0.025305 | 16354.19 | 146931.5 | 88.9% | 11.1% |
| 5.0 | 0.416667 | 0.208137 | 134513.3 | 1 | 0.083333 | 0.029545 | 19093.81 | 153607.1 | 87.6% | 12.4% |

FIG. 15

LOW PROFILE CASCADE AERATOR

CROSS REFERENCE TO RELATED APPLICATIONS

This application claims priority to U.S. Provisional Patent Application Ser. No. 61/766,969, which was filed on Feb. 20, 2013, and which is herein incorporated by reference in its entirety.

TECHNICAL FIELD AND BACKGROUND OF THE INVENTION

Cascade aerators may be employed to raise the dissolved oxygen (DO) concentration level in a fluid flowing though the aerator. In particular, low-profile cascade aerators may be used without requiring large elevation changes.

Low-profile cascade aerators may include a plurality of longitudinal channels, wherein each channel may be in fluid communication with a flow control gate. Each longitudinal channel may further include a plurality of aeration plates.

Applicant has identified a number of deficiencies and problems associated with the manufacture, use, and maintenance of cascade aerators. Through applied effort, ingenuity, and innovation, Applicant has solved many of these identified problems by developing a solution that is embodied by the present invention, which is described in detail below.

BRIEF SUMMARY

Various embodiments of the present invention are directed to a flow control gate for a low-profile cascade aerator. In some embodiments, a cascade aerator for increasing the level of dissolved oxygen flowing therethrough may include a trough having a sloping bottom surface inclined slightly from the horizontal and sloping from a first end to a second end. Further, the aerator may include a plurality of dividers coupled to or disposed near the bottom surface, wherein the plurality of dividers are configured to provide for a plurality of longitudinal flow channels, each of the longitudinal flow channels having a first end and a second end. In some embodiments, the aerator may include a plurality of low head baffles coupled to or disposed near the bottom wall along a transverse direction from a fluid flow direction, wherein a first low head baffle is disposed according to a spaced relationship to at least another low head baffle. In addition, in some embodiments, the aerator may include a plurality of flow control gates, including weirs and/or orifices, wherein each of the flow control gates are disposed proximate a first end of a respective longitudinal flow channel, wherein each of the flow control weirs are disposed along a transverse direction from the fluid flow direction. In some embodiments, the flow control gates may comprise a crest having a horizontal length and a nappe having a horizontal length, wherein the nappe horizontal length is greater than the crest horizontal length.

In some embodiments, the aerator of the present invention may include a plurality of flow control gates, wherein a first number of flow control gates are in fluid communication with a first longitudinal channel and a second number of flow control gates are in fluid communication with a second longitudinal channel, wherein the first number of flow control gates define a crest height that is lower, along a vertical direction, than a crest height defined by the second number of flow control gates.

In some embodiments, one or more of the flow control gates may be flow control weirs. In some embodiments, one or more of the flow control gates may be flow control orifices, wherein the flow control orifice may be configured to be completely submerged when the fluid flowing through the first and second longitudinal channels exceeds a predetermined threshold flow rate.

In some embodiments, wherein the plurality of flow control gates may define a crest length defined proximate a crest of the flow control gate, and a nappe length defined proximate a first height above the crest, wherein the nappe length may be greater than the crest length. In some embodiments, a crest length of the second number of flow control gates may be greater than a crest length of the first number of flow control gates. In some embodiments, wherein at least one of a height of the first flow control gates and a height of the second flow control gates may be adjustable.

In some embodiments, the cascade aerator of the present invention may include a plurality of low head baffles extending from respective bases surfaces of the first and second longitudinal channels, and may also include a plurality of aeration plates coupled to the plurality of low head baffles. The plurality of aeration plates may extend from low head baffles to define a plurality of openings configured to allow the fluid to flow therethrough. In some embodiments, each opening may define a baffle crest length defined proximate a crest of the low head baffle, and a baffle nappe length defined proximate a second height above the crest of the low head baffle. In some embodiments the baffle nappe length may be greater than the baffle crest length.

In some embodiments, at least one of the flow control gates may be trapezoidal in shape. And in some embodiments, the longitudinal channels may be sloped from a first end to a second end such that the first and second longitudinal channels are configured to convey the fluid towards the second end via gravity.

In some embodiments, at least one flow control gate may further comprise at least one aeration plate projecting substantially upward into the at least one flow control gate.

In some embodiments of the present invention, the second number of flow control gates may be structured to define a flow control height so as to encourage the fluid to enter the second longitudinal channel when at least 10% of a total flow rate is received by the first longitudinal channel. In some other embodiments the second number of flow control gates may be structured to define a flow control height so as to encourage the fluid to enter the second longitudinal channel when a height of fluid flowing through the first number of flow control gates is at least one inch. The height of fluid may be defined as a vertical distance between a crest of the flow control gate and a top of the fluid.

Alternative embodiments of the present invention include a plurality of longitudinal channels configured to receive a fluid therethrough, and may include a plurality of flow control gates. In some embodiments, a first number of flow control gates may be in fluid communication with a first longitudinal channel and a second number of flow control gates may be in fluid communication with a second longitudinal channel. In some embodiments, the plurality of flow control gates may define a crest length defined proximate a crest of the flow control gate, and a nappe length defined proximate a first height above the crest, wherein the nappe length may be greater than the crest length.

In some embodiments, one or more of the flow control gates may be flow control weirs. In some embodiments, one or more of the flow control gates may be flow control orifices, wherein the flow control orifice may be configured to be completely submerged when the fluid flowing through the first and second longitudinal channels exceeds a predetermined threshold flow rate.

In some embodiments, a crest length of the second number of flow control gates may be greater than a crest length of the first number of flow control gates. In some embodiments, the first number of flow control gates define a crest height that is lower, along a vertical direction, than a crest height defined by the second number of flow control gates.

In some embodiments of the present invention, the second number of flow control gates may be structured to define a flow control height so as to encourage the fluid to enter the second longitudinal channel when at least 10% of a total flow rate is received by the first longitudinal channel. In some other embodiments the second number of flow control gates may be structured to define a flow control height so as to encourage the fluid to enter the second longitudinal channel when a height of fluid flowing through the first number of flow control gates is at least one inch. The height of fluid may be defined as a vertical distance between a crest of the flow control gate and a top of the fluid.

In some embodiments, the cascade aerator of the present invention may include a plurality of low head baffles extending from respective bases surfaces of the first and second longitudinal channels, and may also include a plurality of aeration plates coupled to the plurality of low head baffles. The plurality of aeration plates may extend from low head baffles to define a plurality of openings configured to allow the fluid to flow therethrough. In some embodiments, each opening may define a baffle crest length defined proximate a crest of the low head baffle, and a baffle nappe length defined proximate a second height above the crest of the low head baffle. In some embodiments the baffle nappe length may be greater than the baffle crest length.

In some embodiments, at least one of the flow control gates may be trapezoidal in shape. In some embodiments, the longitudinal channels may be sloped from a first end to a second end such that the first and second longitudinal channels may be configured to convey the fluid towards the second end via gravity.

In some embodiments, each of the at least one flow control gates may further comprise at least one aerator plate projecting substantially upward into the at least one flow control gate.

Some alternative embodiments may include a plurality of low head baffles extending from respective bases surfaces of the first and second longitudinal channels, and may also include a plurality of aeration plates coupled to the plurality of low head baffles. The plurality of aeration plates may extend from low head baffles to define a plurality of openings configured to allow the fluid to flow therethrough. In some embodiments, each opening may define a baffle crest length defined proximate a crest of the low head baffle, and a baffle nappe length defined proximate a second height above the crest of the low head baffle. In some embodiments the baffle nappe length may be greater than the baffle crest length.

Some embodiments may further include a plurality of flow control gates, wherein a first number of flow control gates may be in fluid communication with a first longitudinal channel and a second number of flow control gates may be in fluid communication with a second longitudinal channel. In some embodiments, the first number of flow control gates may define a crest height that is lower, along a vertical direction, than a crest height defined by the second number of flow control gates. In some embodiments, the plurality of flow control gates may define a crest length defined proximate a crest of the flow control gate, and a nappe length defined proximate a first height above the crest, wherein the nappe length may be greater than the crest length.

BRIEF DESCRIPTION OF THE SEVERAL VIEWS OF THE DRAWINGS

Figure 1:
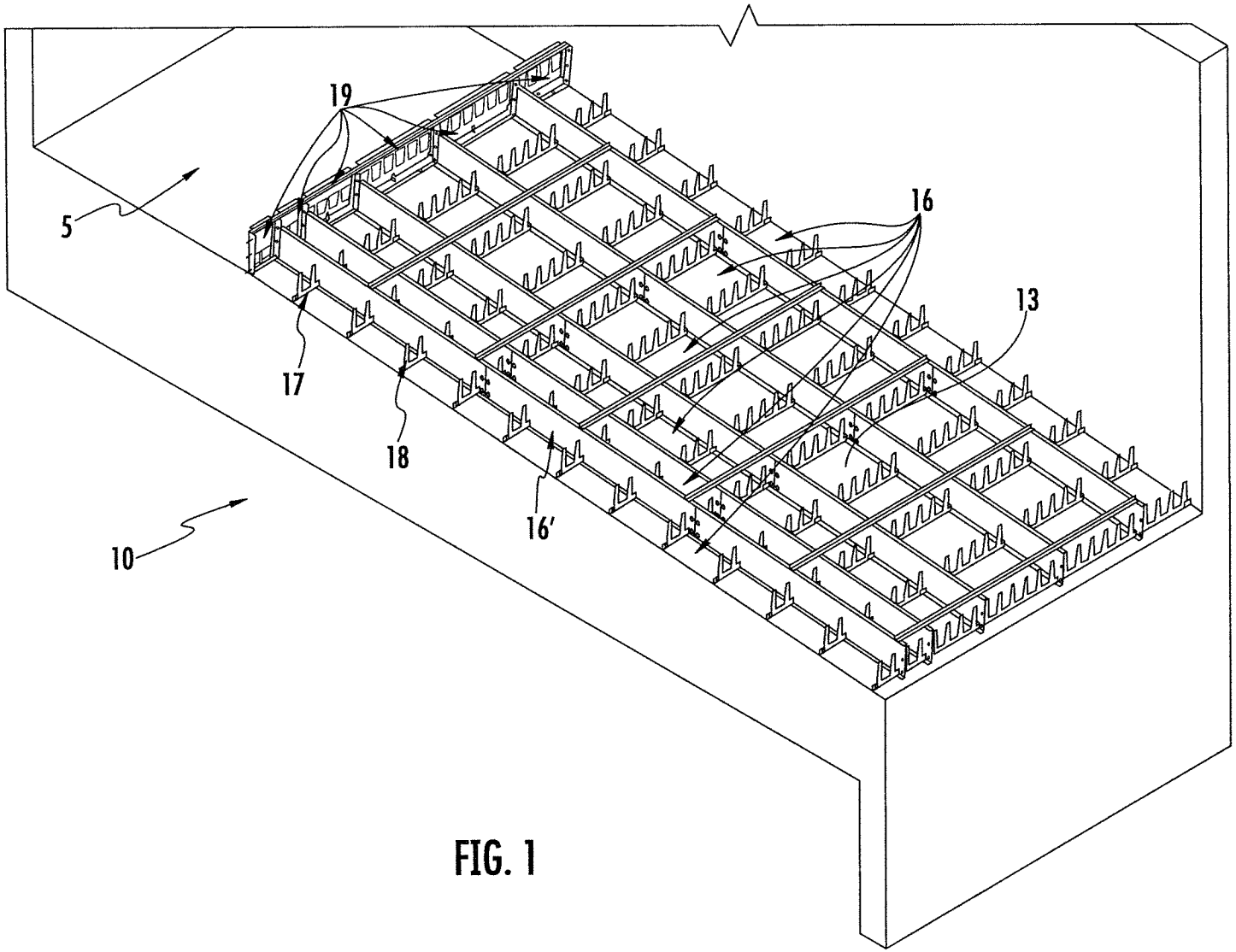
Figure 2:
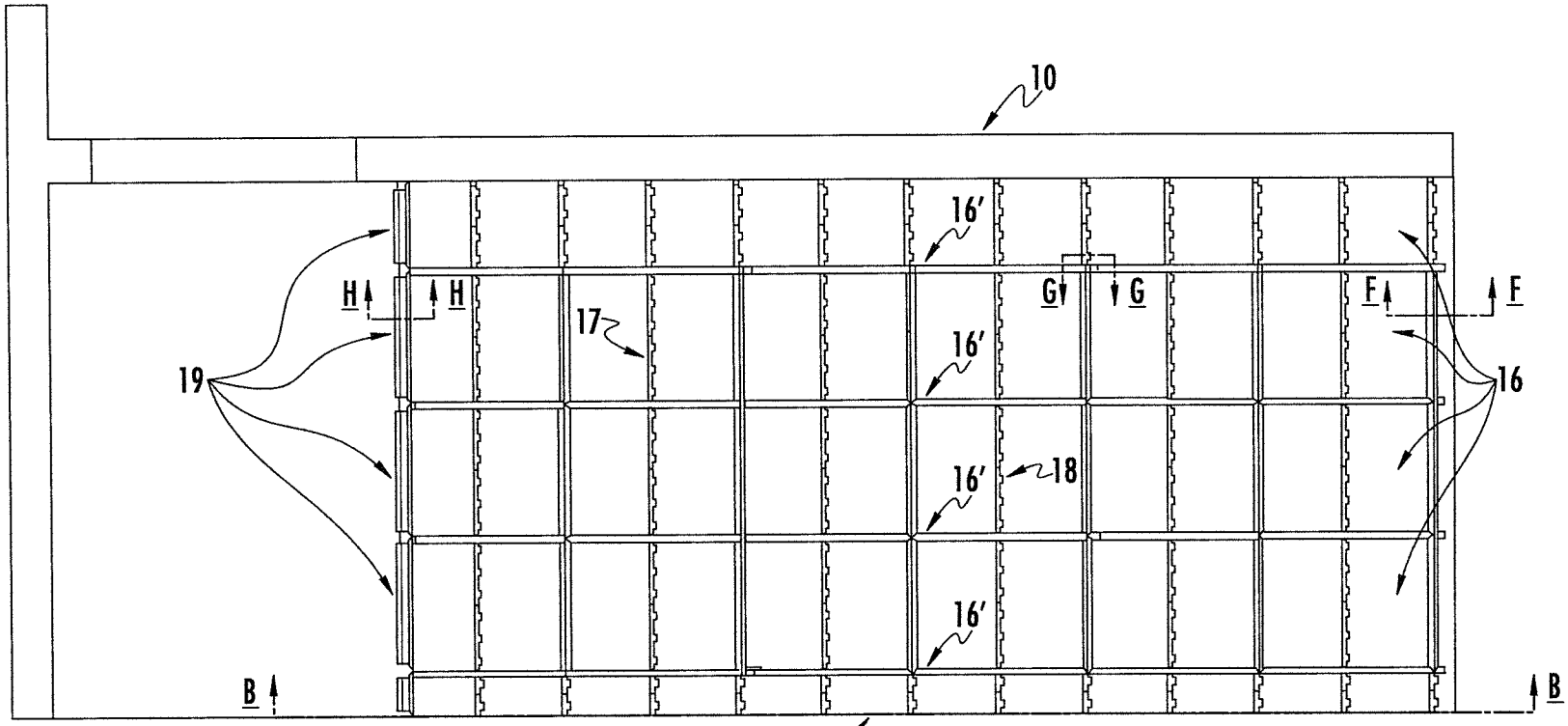
Figure 3:
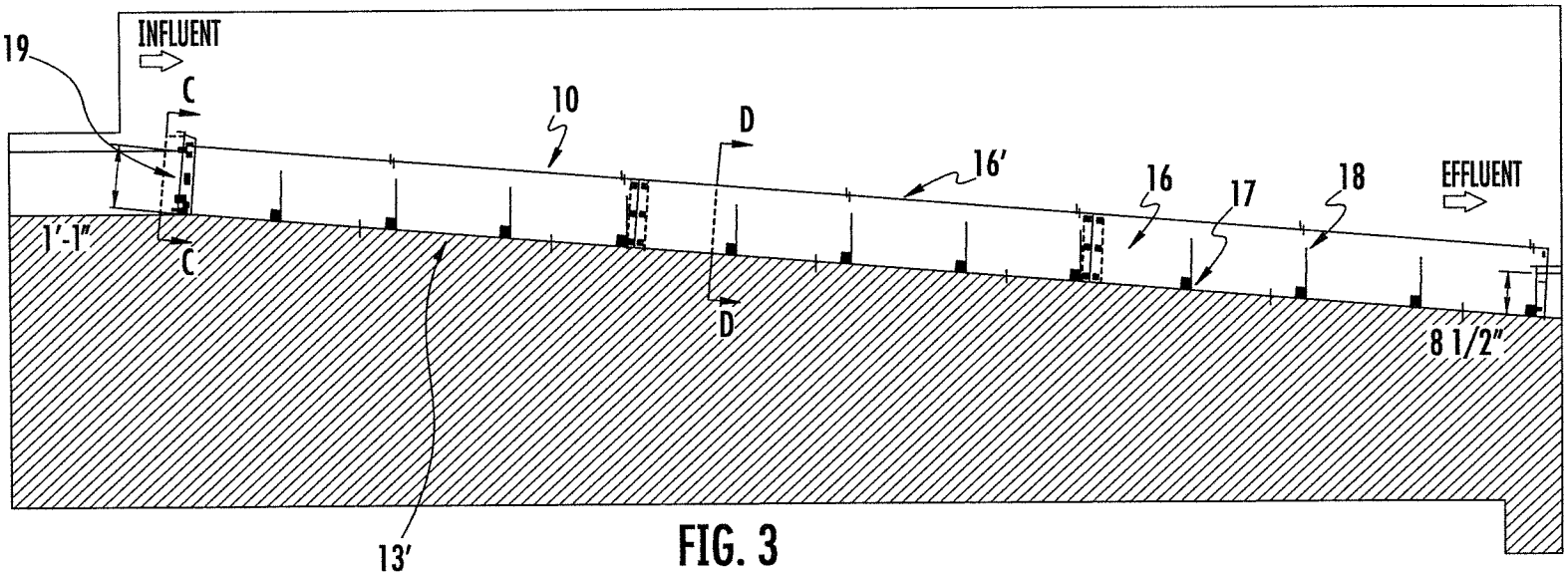
Figure 4:
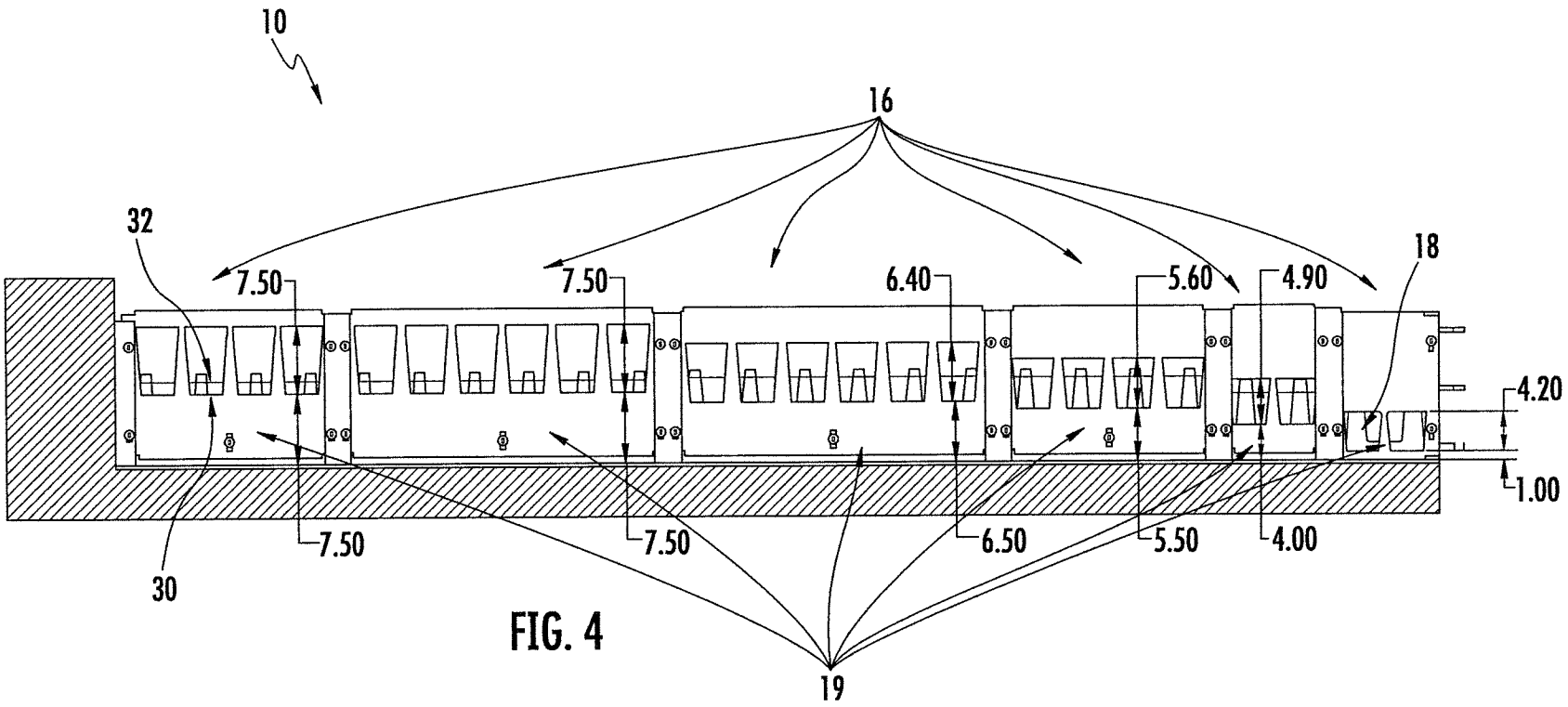
Figure 5A:
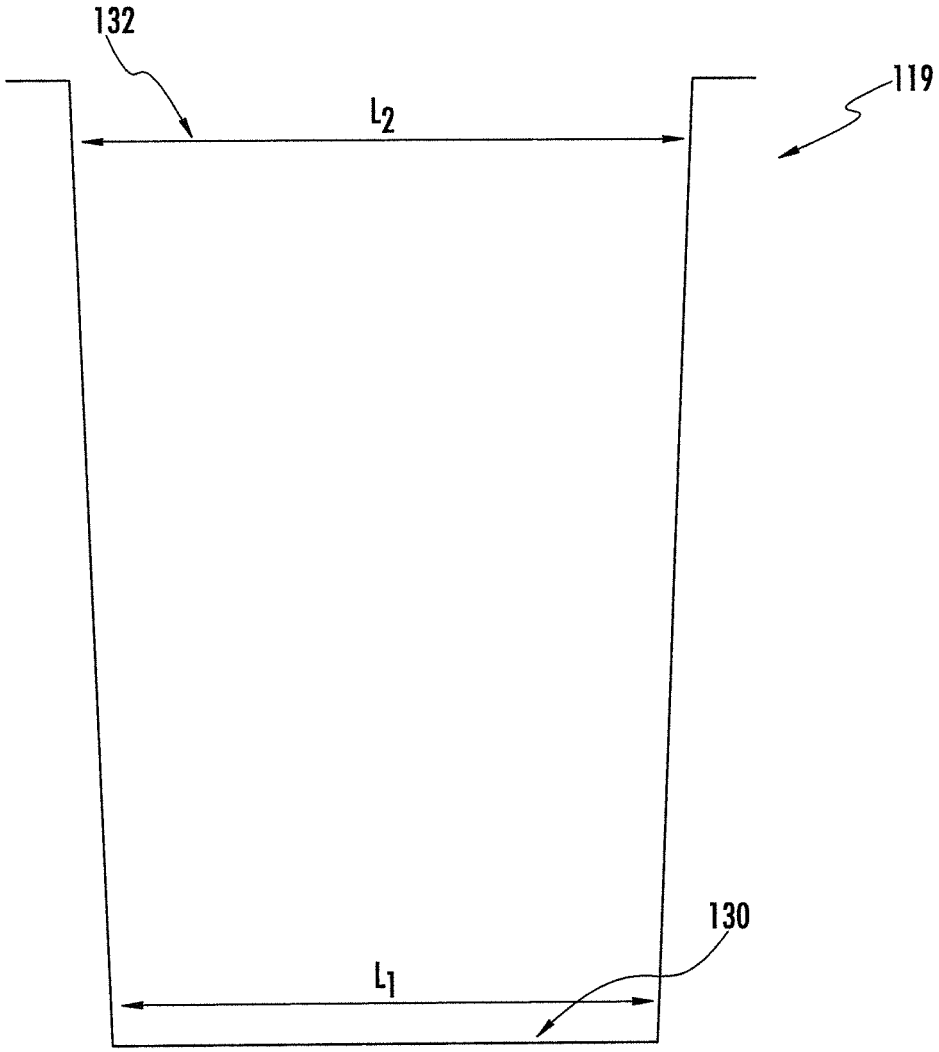
Figure 5B:
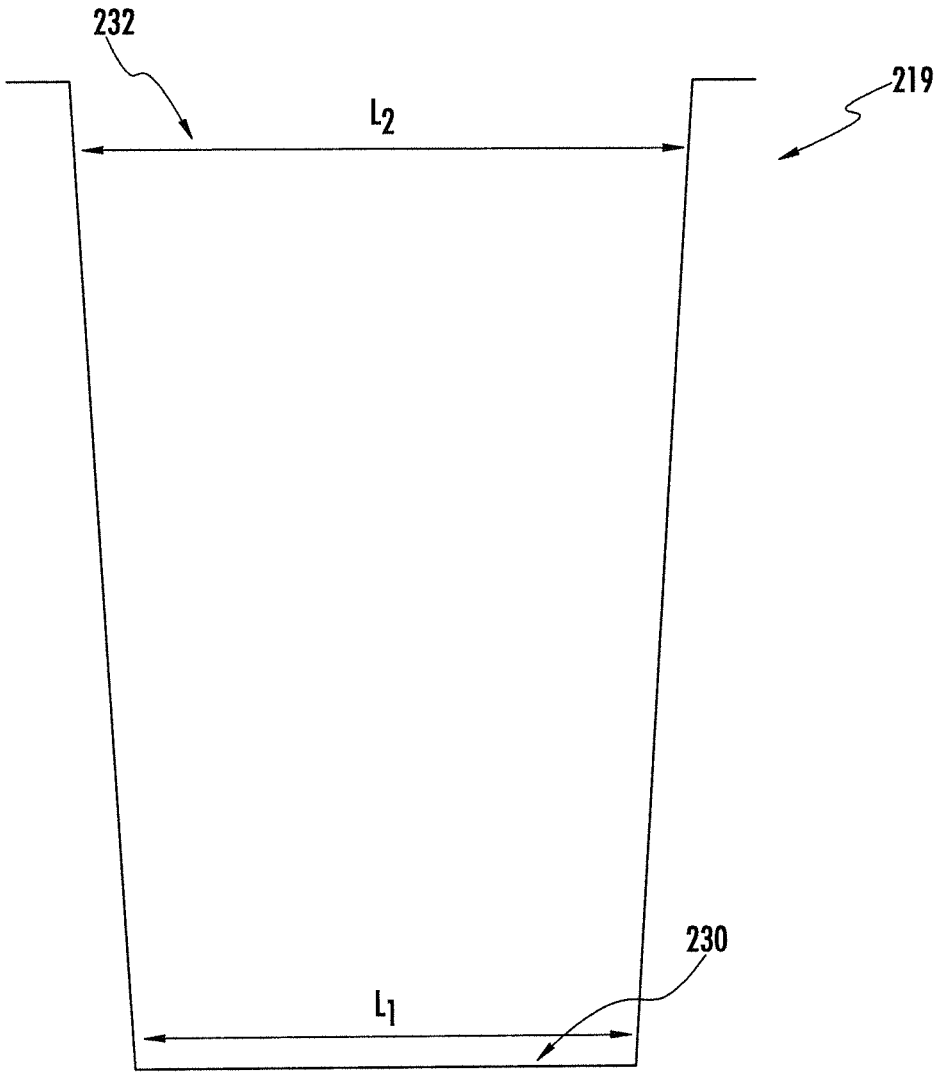
Figure 5C:
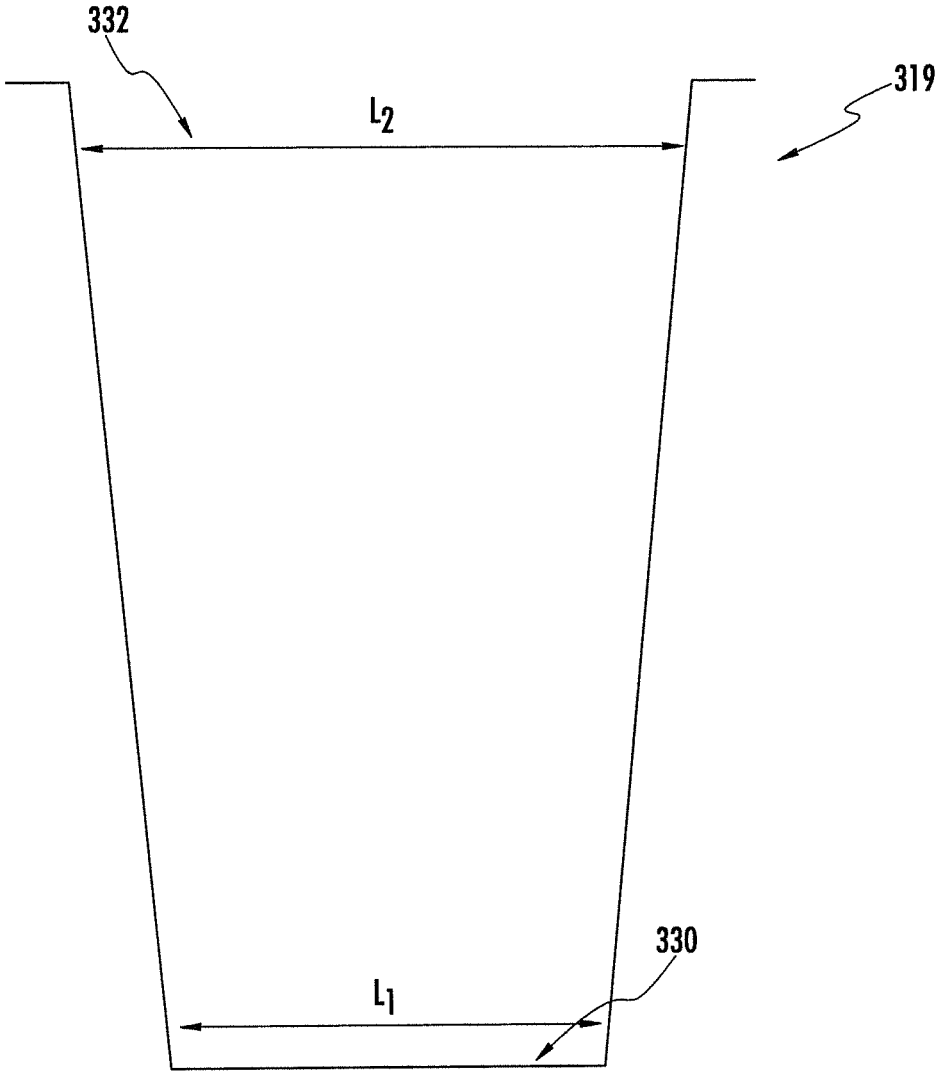
Figure 6:
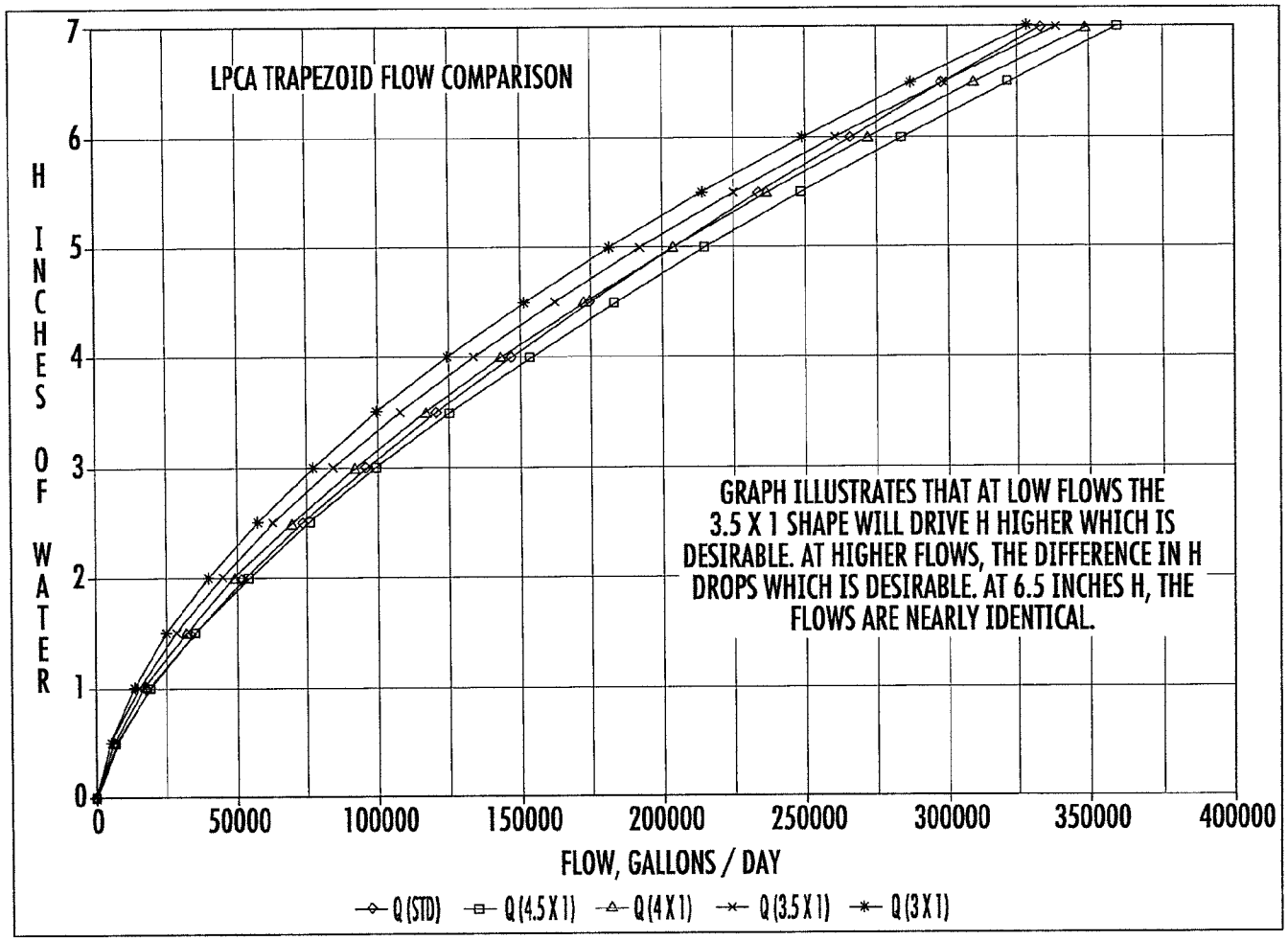
Figure 8:
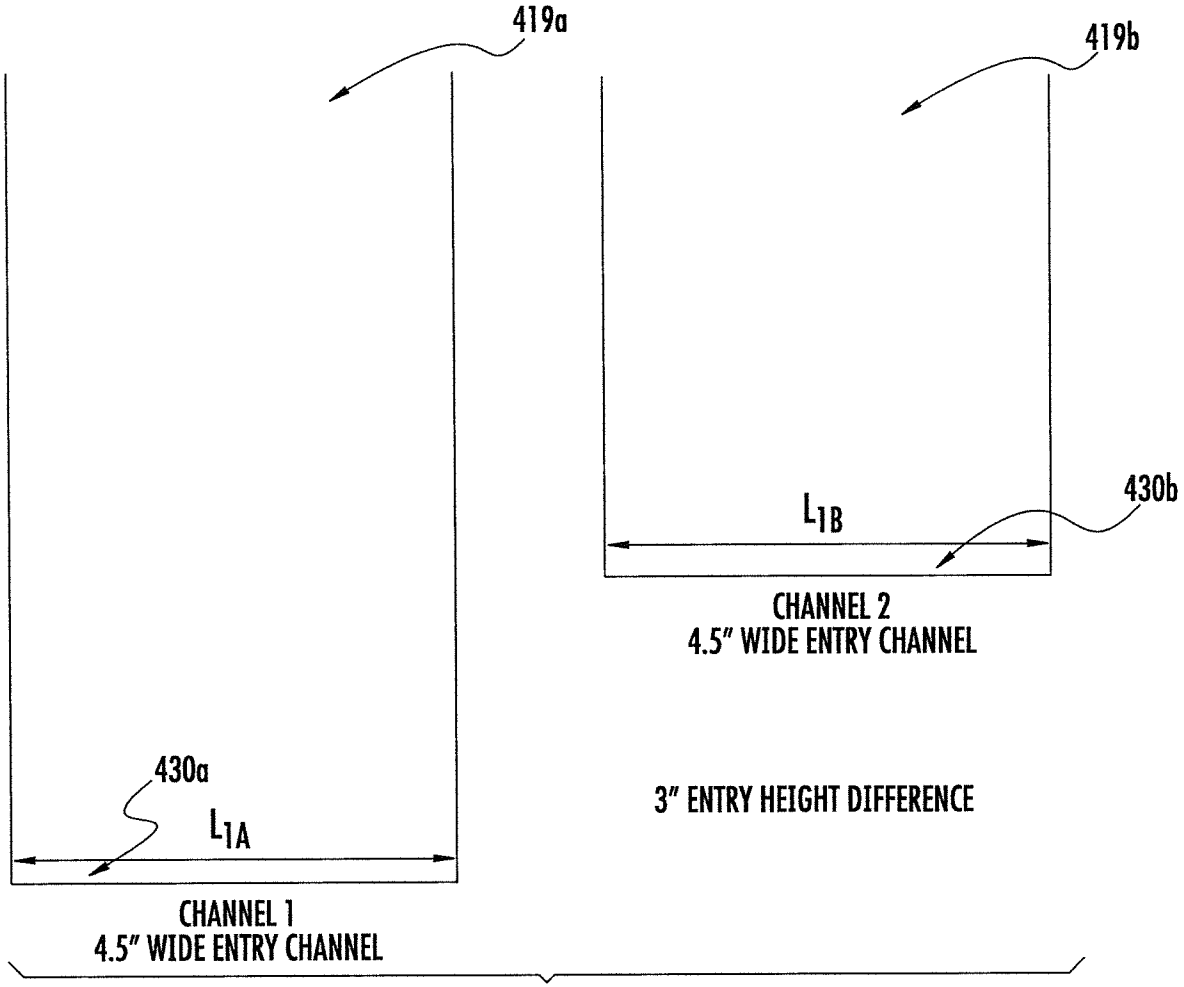
Figure 9:
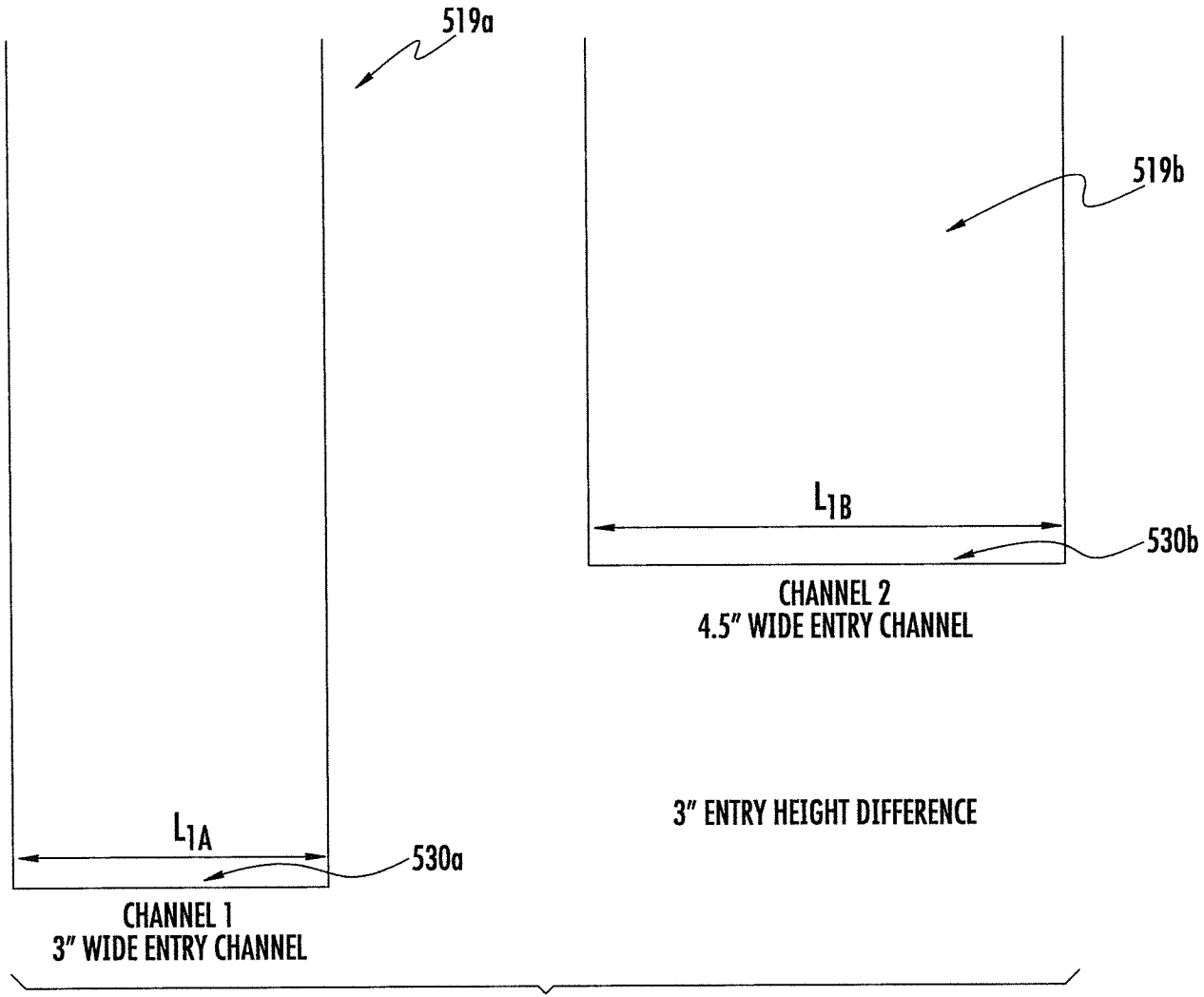
Figure 10:
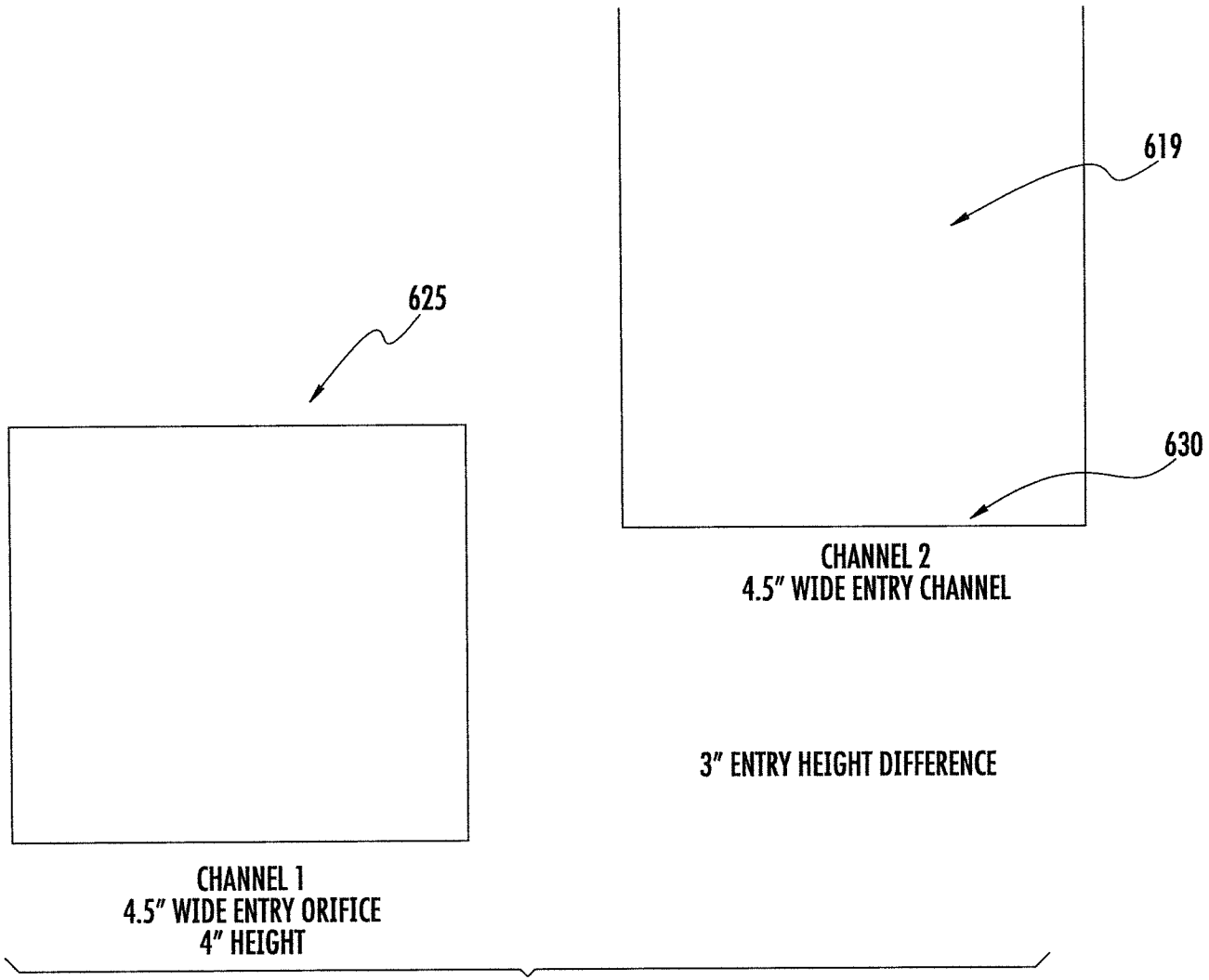
Figure 11:
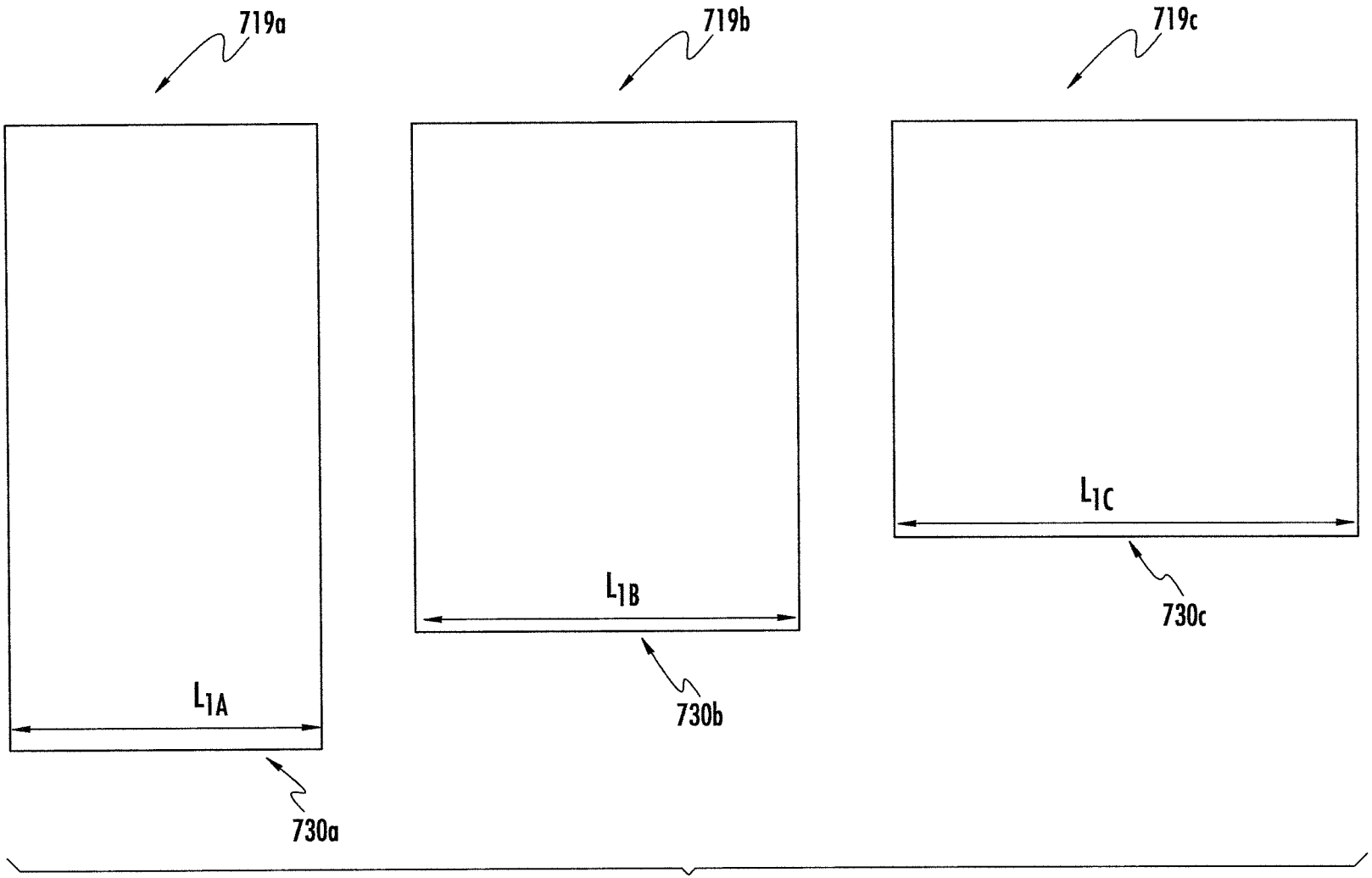
Figure 16:
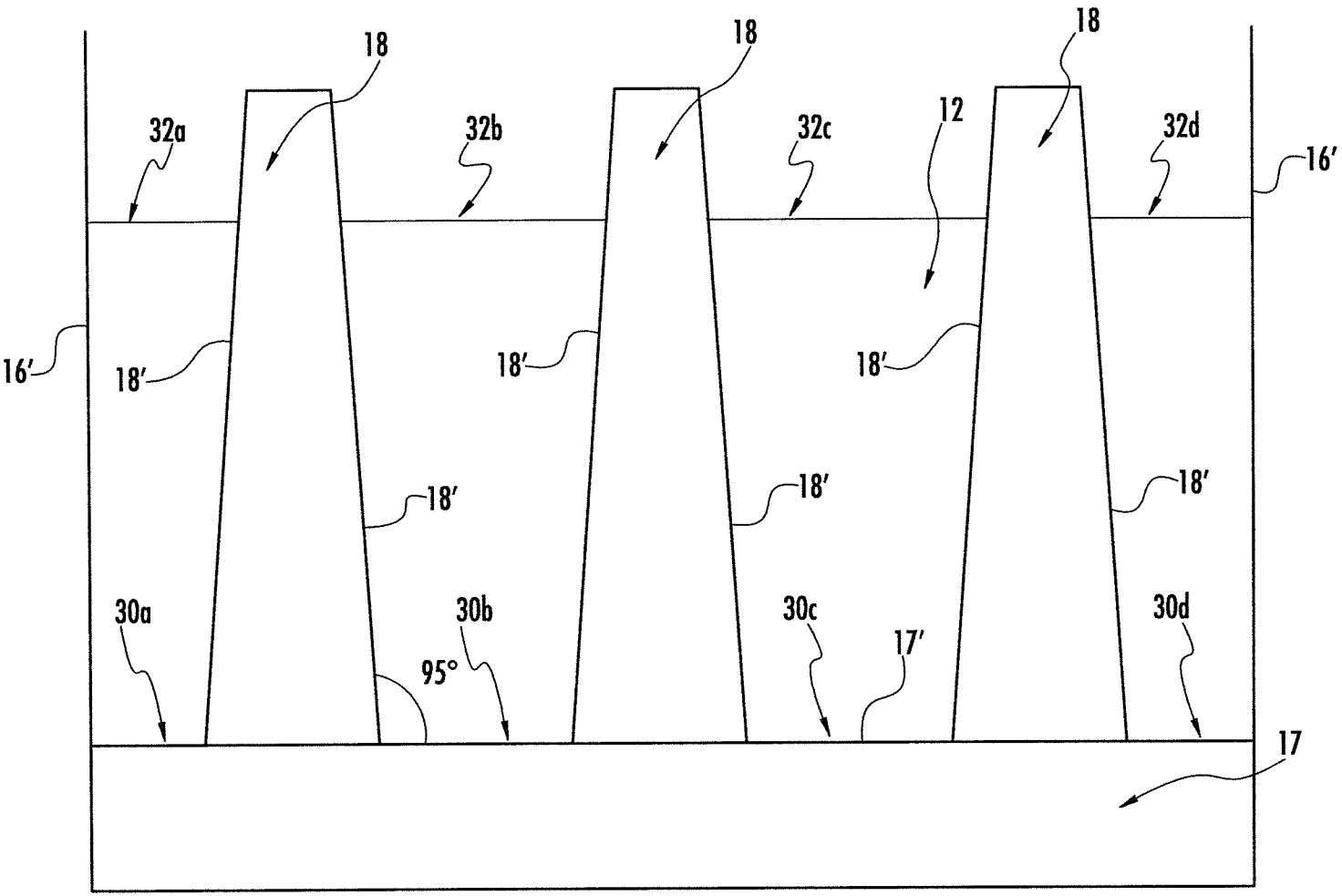
Figure 17:
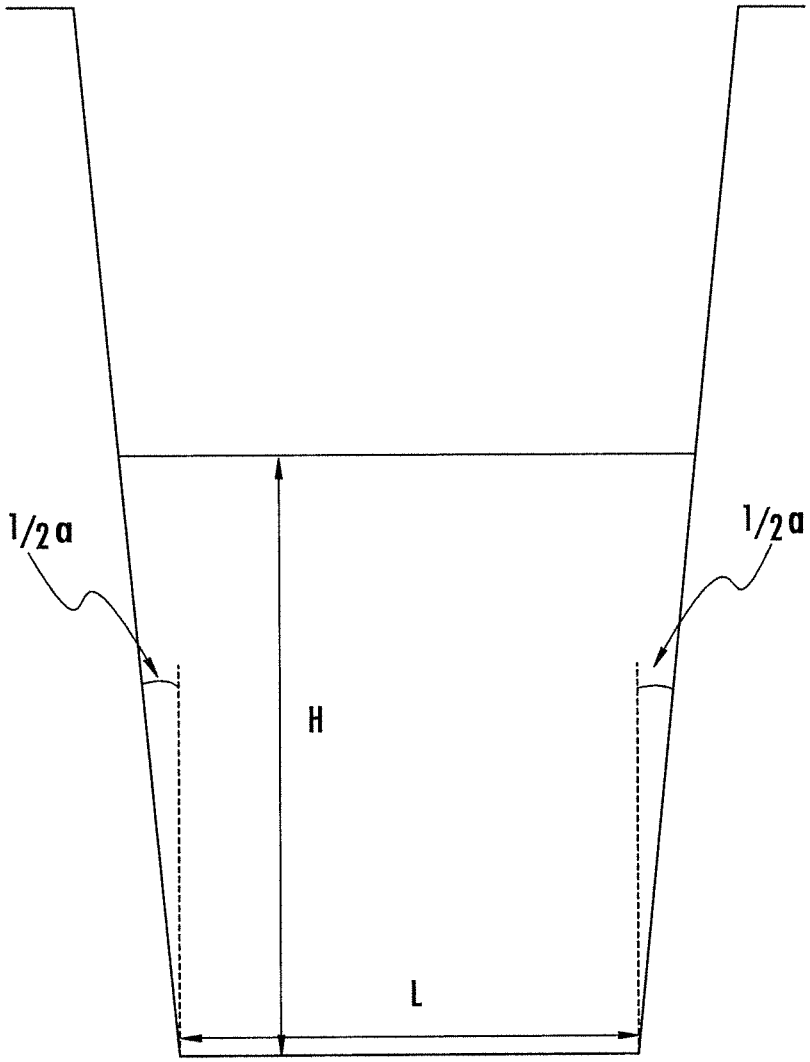
Figure 18:
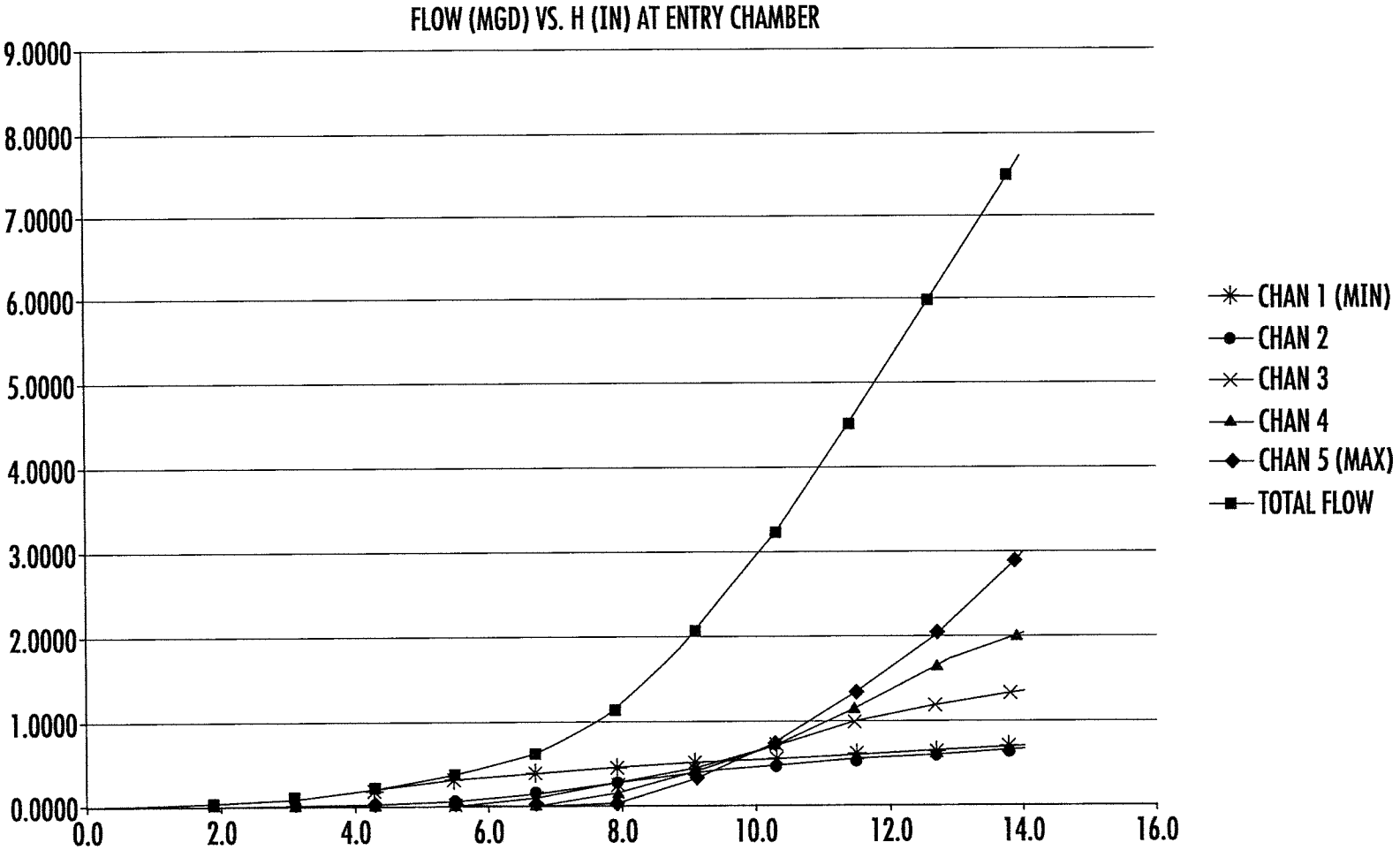

Having thus described the invention in general terms, reference will now be made to the accompanying drawings, which are not necessarily drawn to scale, and wherein:

FIG. 1 illustrates a perspective view of a cascade aerator according to an example embodiment of the present invention;

FIG. 2 illustrates a top view of a cascade aerator according to an example embodiment of the present invention;

FIG. 3 illustrates a vertical sectional view of a cascade aerator on the plane of line B-B in FIG. 2 according to an example embodiment of the present invention;

FIG. 4 illustrates a frontal view of a plurality of flow control gates of a cascade aerator according to an example embodiment of the present invention;

FIG. 5A illustrates a frontal view of a flow control gate according to an example embodiment of the present invention;

FIG. 5B illustrates a frontal view of a flow control gate according to an example embodiment of the present invention;

FIG. 5C illustrates a frontal view of a flow control gate according to an example embodiment of the present invention;

FIG. 6 illustrates a graph comparing the fluid flow rate to the height of the fluid for differing flow control gates according to example embodiments of the present invention;

FIG. 7 illustrates experimental data disclosing fluid flow rate for a height of the fluid for differing flow control gates according to example embodiments of the present invention;

FIG. 8 illustrates a frontal view of a plurality of flow control gates for a plurality of longitudinal channels of a cascade aerator according to an example embodiment of the present invention;

FIG. 9 illustrates a frontal view of a plurality of flow control gates for a plurality of longitudinal channels of a cascade aerator according to an example embodiment of the present invention;

FIG. 10 illustrates a frontal view of a flow control weir and submerged flow control orifice for a plurality of longitudinal channels of a cascade aerator according to an example embodiment of the present invention;

FIG. 11 illustrates a frontal view of a plurality of flow control gates according to an example embodiment of the present invention;

FIG. 12 illustrates experimental data disclosing fluid flow rate for a height of the fluid according to example embodiments of the present invention;

FIG. 13 illustrates experimental data disclosing fluid flow rate for a height of the fluid according to example embodiments of the present invention;

FIG. 14 illustrates experimental data disclosing fluid flow rate for a height of the fluid according to example embodiments of the present invention;

FIG. 15 illustrates experimental data disclosing fluid flow rate for a height of the fluid according to example embodiments of the present invention;

FIG. 16 illustrates a frontal view of a transverse baffle and a plurality of aeration plates according to an example embodiment of the present invention;

FIG. 17 illustrates a frontal view of a flow control gate according to one embodiment of the present invention; and FIG. 18 illustrates a graph detailing the fluid flow rates through a plurality of the longitudinal channels according to one embodiment of the present invention.

DETAILED DESCRIPTION OF THE INVENTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

FIG. 1 illustrates a cascade aerator 10 according to an example embodiment of the present invention. For example, the aerator may comprise a low profile cascade aerator as disclosed in U.S. Pat. No. 5,259,996, which is hereby incorporated in its entirety by reference herein. According to some embodiments, the low profile cascade aerator 10 may be disposed in a fluid-containing basin and configured to increase the concentration of dissolved oxygen level in the fluid. The basin may comprise a tank, reservoir, and/or pipe line that receives the fluid from a wastewater treatment facility.

The low profile cascade aerator 10 may include a trough 13 having a sloping bottom surface 13', as shown in FIG. 3. The aerator may be integrated with the trough, or may be separately placed in the trough to facilitate aeration. In some embodiments, the sloping bottom surface 13' may have a slope of between 4° and 5.5°. In some embodiments, the sloping bottom surface 13' may have a slope of approximately 4.76°. The trough 13 may but does not necessarily include a plurality of dividers 16' disposed proximate the sloping bottom surface 13' so as to define a plurality of longitudinal channels 16. Although FIG. 1 illustrates a trough having six longitudinal channels, one of ordinary skill in the art may appreciate a trough to have any number of longitudinal channels.

An inlet of the cascade aerator 10 may be submerged below the fluid surface to inhibit floatable solids from passing through the aerator. In another embodiment, solids may be separated before the fluid passes through the inlet of the aerator. In addition, a horizontal gate may be provided at the inlet for flow monitoring and basin low water level control. The gate may be adjusted upwardly for varying the basin liquid level. In some embodiments, each of the longitudinal channels may slope downwardly and direct flow to a common receptacle, which may connect to an outlet that is in fluid communication with a basin.

As shown in FIGS. 1-4, each longitudinal channel 16 is controlled at the inlet with at least one flow control gate 19. A plurality of flow control gates 19 may be disposed at the inlet of each longitudinal channel as shown in FIG. 1. In this regard, a flow control gate 19 may be configured to optimize the fluid flow through each of the longitudinal channels, in conjunction with a plurality of transverse baffles 17 and a plurality of aeration plates 18, to optimize the concentration level of dissolved oxygen in the fluid. In some embodiments, adjacent flow control gates 19 may be stepped or increased in height with respect to one another. According to some embodiments, adjacent flow control gates 19 may be stepped or increased in height with respect to one another and/or may have an increased width with respect to one another, as illustrated in FIGS. 9 and 11. In addition, as shown in FIGS. 4-5A, at least one of the flow control gates 19 may define a flow control orifice or a flow control weir configured to optimize the fluid flow through each of the longitude channels, as explained in further detail herein.

The foregoing figures may show a single flow control gate for illustration purposes. However, in other embodiments, one of ordinary skill in the art will appreciate that a single flow control gate may be replaced with two or more flow control gates, consistent with FIG. 4. For example, FIG. 8 discloses two flow control gates 419*a*, 419*b* disposed at different heights with respect to one another. As shown in FIG. 4, a plurality of flow control gates may be used in place of each single flow control gate, such that groups of one or more flow control gates are in fluid communication with a single longitudinal channel and disposed at different heights with respect to another group of one or more flow control gates in fluid communication with another channel.

Some embodiments of the present invention reference flow rates and dimensions of various flow control gates. One of ordinary skill in the art will appreciate that the disclosed dimensions may apply to the sum total of the dimensions of a plurality of flow control gates disposed in front of a single channel, or the dimensions may refer to an individual flow control gate. For example, the embodiment shown in FIG. 13 discloses a first and second channel having a rectangular opening with a predetermined width of 4.5 inches. One of ordinary skill in the art will appreciate that multiple openings, having a total width of 4.5 inches, may be used for each channel. In some alternative embodiments, such as shown in FIG. 8, two or more flow control gates may combine to form a 4.5 inch entry channel for a single longitudinal channel, or each of the flow control gates disposed in front of a single longitudinal channel may have a width of 4.5 inches.

According to some embodiments, a flow control gate 19 may include a crest 30 and a nappe 32, as shown in FIG. 4. The crest 30 may be defined by the lowest elevation of the flow control gate 19 over which the fluid flows, while the nappe 32 may be defined by an elevation above the crest, such as the elevation at which the stream of fluid exits over the flow control gate 19. Accordingly, the difference in elevation between the nappe 32 and the crest 30 may depend on the fluid flow rate. For example, at a low flow rate, the nappe 32 and the crest 30 may be disposed at and/or near the same elevation, whereas at a high flow rate, the nappe 32 may be disposed at an elevation greater than the crest 30.

A flow control gate 19 may define a trapezoidal shaped weir, opening, orifice, and/or the like. As shown in FIGS. 5A-5C, a flow control gate 19 and/or a plurality of aeration plates may define a trapezoidal shaped opening configured to allow water to flow between the side edges of the trapezoidal shaped flow control gate and/or aeration plates. For example, FIGS. 5A-5C illustrate a flow control weir shaped according to exemplary embodiments of the present invention, wherein the distance between the side edges at the top of the flow control gate and/or aeration plates is greater than the distance between the side edges at the bottom of the flow control gate and/or aeration plates. As such, some embodiments of a flow control gate and/or aeration plates are configured to provide for a similar head at a lower flow rate when compared to the flow rate through known flow control gates. In addition, some embodiments advantageously provide a similar head at a similar higher flow rate when compared to known flow control gates. Accordingly, embodiments of the present invention may be configured to provide an increased dissolved oxygen concentration at a lower flow rate, as the head would be similar to the head of a fluid in a known flow control gate, when compared to the flow rate of a known flow control gate configured to provide a similar head height, as discussed in further detail herein.

According to some embodiments, a flow control gate 119 may be defined by a trapezoidal shape and may include a crest 130 that defines a crest length $L_1$ and a nappe 132 that defines a nappe length $L_2$, as shown in FIG. 5A. In some embodiments, the crest length and the nappe length may differ from one another. As shown in FIG. 5A, the nappe length $L_2$ may be greater than the crest length $L_1$. For example, the crest length $L_1$ may be approximately 4.5 inches, and at a maximum flow rate, the maximum nappe length $L_2$ may be approximately 5 inches.

In some embodiments, the crest length and the nappe length may be equal to one another. For example, at a minimum flow rate, the crest 130 and the nappe 132 may be disposed at a substantially similar elevation. As the fluid flows over the flow control gate 119 at the crest 130, and the elevation of the fluid flowing over the flow control gate is substantially zero such that the crest 130 and the nappe 132 are disposed at a substantially similar elevation, the nappe length $L_2$ may equal the crest length $L_1$. As shown in FIG. 5A, the nappe length $L_2$ may increase from a minimum length equal to the crest length to a maximum length greater than the crest length as the elevation between the nappe and the crest increases.

FIGS. 5B and 5C illustrate a flow control gate according to another embodiment of the present invention. FIG. 5B illustrates a flow control gate 219 including a crest 230 defining a crest length $L_1$ of approximately 4 inches. In addition, the flow control gate 219 may include a nappe 230 that at maximum could define a nappe length $L_2$ of approximately 5 inches. FIG. 5C illustrates a flow control gate 319 including a crest 330 defining a crest length $L_1$ of approximately 3.5 inches. Further, the flow control gate 319 may include a nappe 332 that at maximum could define a nappe length $L_2$ of approximately 5 inches.

As shown in FIGS. 6 and 7, example embodiments may provide flow control gates configured to provide desired flow characteristics, such as providing greater nappe heights at lower flow rates when compared to the flow rate for the same nappe height for known flow control gates. In addition, example embodiments may further provide for similar nappe heights at higher flow rates when compared to the same higher flow rate for known flow control gates. In this regard, a flow control gate 319, according to the embodiment illustrated in FIG. 5C, may provide an equivalent nappe height at a lower flow rate equal to the nappe height for a known flow control gate experience a greater flow rate. Specifically, a flow control gate 319, as shown in FIG. 4C, may provide a nappe height of approximately 0.5 inches at a flow rate approximately 21% less than a flow rate necessary to maintain a nappe height of approximately 0.5 inches in a known flow control gate. In addition, embodiments may include a flow control gate 319 configured to provide a nappe height of approximately 7 inches at a flow rate approximately 1% greater than a flow rate necessary to maintain a nappe height of approximately 7 inches in a known flow control gate. As such, embodiments of the present invention may advantageously provide a flow control gate configured to provide for a greater nappe height at a lower flow rate. Further, embodiments of the present invention may advantageously provide a flow control gate configured to provide for a similar nappe height at higher flow rates.

As previously mentioned, a flow control gate 19 may be configured to optimize the fluid flow through each of the longitudinal channels, and in some embodiments, a first flow control gate may be stepped or increased or decreased in height with respect to a second flow control gate. Additionally or alternatively, as shown in FIG. 4, for example, the flow control gates 19 in front of each longitudinal channel 16 may be stepped in height with respect to the flow control gates in front of another longitudinal channel such that the crests 30 of a first number of flow control gates in fluid communication with a first channel define a crest height that is lower, along a vertical direction, than a crest height of a second number of flow control gates in fluid communication with a second channel.

For example, FIG. 8 illustrates a frontal view of a plurality of flow control gates 419*a*, 419*b* configured to be in fluid communication with respective longitudinal channels. Specifically, a second flow control gate 419*b* in fluid communication with a second longitudinal channel may be disposed at a higher elevation than a first flow control gate 419*a* in fluid communication with a first longitudinal channel. In some embodiments, the elevations of the flow control gates may be adjusted in accordance with the fluid flow rate to advantageously provide for increasing the concentration level of dissolved oxygen in the fluid.

As shown in FIG. 8, a first flow control gate 419*a* for a first longitudinal channel may have a crest 430*a* disposed at a lower elevation than a crest 430*b* for a second flow control gate 419*b* for a second longitudinal channel. According to some embodiments, the fluid flow rate may be great enough to flow only over the first crest 430*a* of the first flow control gate 419*a* for the first longitudinal channel. For example, the second crest 430*b* may be disposed at an elevation approximately 3 inches above the first crest 430*a*. As such, when the fluid flow rate is great enough to produce a nappe height of less than 3 inches in the first flow control gate 419*a*, the fluid will flow only over the first flow control gate, through the first longitudinal channel, and will not flow over the second flow control gate 419*b* or through a second longitudinal channel. In some embodiments, the crest 430*b* for the second flow control gate 419*b* may be disposed at an elevation approximately 3.5 or 4 inches higher than the crest 430*a* of the first flow control gate 419*a*. Although FIG. 8 illustrates a second crest 430*b* disposed approximately 3 inches higher than a first crest 430*a*, one of ordinary skill in the art may appreciate that the elevation between a first crest and a second crest may differ by any amount greater than zero.

As disclosed in FIG. 12, the amount of fluid flowing through a first and second longitudinal channel may be manipulated based at least in part on the difference in height between a second crest 430*b* of a second flow control gate 419*b* and a first crest 430*a* of a first flow control gate 419*a* for a first and second longitudinal channel respectively. Specifically, FIG. 12 discloses the fluid flow rates through a first and second longitudinal channel when the height between the second crest 430*b* and the first crest 430*a* differ by approximately 3", 3.5" and 4" respectively.

As shown in FIG. 12, the amount of fluid flowing through a first longitudinal channel when the crest of the second flow control gate is disposed approximately 3 inches higher than the crest of the first flow control gate may be approximately 88.5% of the total fluid flowing through the first and second longitudinal channels when the total fluid flow rate is great enough to produce a nappe height of approximately 4 inches in the first flow control gate. In another embodiment wherein the crest of the second flow control gate is disposed approximately 3.5 inches higher than the crest of the first flow control gate, the amount of fluid flowing through the first longitudinal channel when the fluid flow rate is great enough to produce a nappe height of approximately 4 inches in the first flow control gate may be approximately 95.5%. Further, when the crest of the second flow control gate is disposed approximately 4 inches higher than the crest of the first flow control gate, the amount of fluid flowing through the first longitudinal channel when the fluid flow rate is great enough to produce a nappe height of approximately 4 inches in the first flow control gate may be approximately 100%.

FIG. 9 illustrates another embodiment of a first and second flow control gate 519*a*, 519*b* configured to be in fluid communication with a first and second longitudinal channel respectively. As shown in FIG. 9, a first flow control gate 519*a* may have a crest 530*a* having a crest length $L_{1A}$ that is less than the crest length $L_{1B}$ of crest 530*b* for a second flow control gate 519*b*. For example, a first flow control gate 519*a* may have a crest 530*a* having a crest length $L_{1A}$ of approximately 3 inches, while a second flow control gate 519*b* may have a crest 530*b* having a crest length $L_{1B}$ of approximately 4.5 inches. In addition, the second crest 530*b* of the second flow control gate 519*b* may be disposed at a higher elevation than the first crest 530*a* of the first flow control gate 519*a*. In some embodiments, the second crest 530*b* may be disposed approximately 3 inches higher than the first crest 530*a*. Although the plurality of flow control gates 519*a*, 519*b* are illustrated in FIG. 9 as having a crest 530*b* for a second flow control gate approximately 3 inches higher than the crest 530*a* of the first flow control gate, one of ordinary skill in the art may appreciate that the crest 530*b* of the second flow control gate may be disposed at any elevation greater than the first crest 530*a* elevation. In addition, one of ordinary skill in the art may appreciate that a crest length $L_{1B}$ of a second flow control gate 519*b* may be greater than the crest length $L_{1A}$ of a first flow control gate 519*a* by any amount greater than zero.

FIG. 14 illustrates data corresponding to one embodiment of the present invention wherein a first longitudinal channel in fluid communication with a first flow control gate defines a first crest having a crest length of approximately 3 inches, and a second longitudinal channel in fluid communication with a second flow control gate defines a second crest having a crest length of approximately 4.5 inches. Further, the first crest of the first flow control gate and the second crest of the second flow control gate are disposed approximately at the same elevation.

FIG. 15 illustrates data corresponding to an embodiment of the present invention wherein a first longitudinal channel in fluid communication with a first flow control gate defines a first crest having a crest length of approximately 3 inches, and a second longitudinal channel in fluid communication with a second flow control gate defines a second crest having a crest length of approximately 4.5 inches, and wherein the first crest of the first flow control gate is disposed at an elevation different from the elevation of the second crest of the second flow control gate. In some embodiments, the elevation difference between the first crest and second crest for the respective first and second flow control gates may be 3", 3.5" or 4". For example, one embodiment is illustrated and disclosed in FIG. 9, wherein the elevation difference between the first and second crests is approximately 3 inches.

As shown in FIG. 15, the amount of fluid flowing through a first longitudinal channel in fluid communication with a first flow control gate, wherein the crest of the second flow control gate is disposed approximately 3 inches higher than the crest of the first flow control gate, may be approximately 83.5% of the total fluid flowing through the first and second longitudinal channels when the fluid flow rate is great enough to produce a nappe height of approximately 4 inches in the first flow control gate. In another embodiment wherein the crest of the second flow control gate is disposed approximately 3.5 inches higher than the crest of the first flow control gate, the amount of fluid flowing through the first longitudinal channel in fluid communication with the first flow control gate when the fluid flow rate is great enough to produce a nappe height of approximately 4 inches in the first flow control gate may be approximately 93.4%. Further, when the crest of the second flow control gate is disposed approximately 4 inches higher than the crest of the first flow control gate, the amount of fluid flowing through the first longitudinal channel in fluid communication with the first flow control gate, when the fluid flow rate is great enough to produce a nappe height of approximately 4 inches in the first flow control gate, may be approximately 100%.

In another embodiment of the present invention, as shown in FIG. 10, a flow control orifice may be fully submerged when the height of the fluid flowing through the flow control orifice is greater than the height of the orifice opening. FIG. 10 illustrates a flow control orifice 625 and a flow control weir 619, wherein each of the flow control orifice and the flow control weir provide fluid flow to a respective longitudinal channel. In this regard, the flow control orifice 625 may be in fluid communication with a first longitudinal channel, while the flow control weir 619 may be in fluid communication with a second longitudinal channel. In some embodiments, the orifice 625 may provide fluid flow to the first longitudinal channel at a lower fluid flow rate, which may not be sufficient enough to flow over the crest 630 of the flow control weir 619 in fluid communication with the second longitudinal channel. In some embodiments, the flow rate may be great enough for the fluid to flow through the flow control orifice 625 and over the crest 630 of the flow control weir 619. Further still, some embodiments may include a fluid flow rate great enough to completely submerge the orifice 625 under the fluid, while simultaneously being great enough to flow over the crest 630 of the flow control weir 619.

FIG. 13 illustrates data corresponding to one embodiment of the present invention wherein a first longitudinal channel is in fluid communication with a flow control orifice having a crest length of approximately 4.5 inches and a second longitudinal channel is in fluid communication with a flow control weir having a crest length of approximately 4.5 inches. In addition, the flow control orifice may have a max opening height of approximately 5 inches, while the flow control weir is configured to permit the flow of water at a height greater than 5 inches. Further, the crest of the flow control weir and the crest of the flow control orifice may be disposed approximately at the same elevation. In some embodiments, the crest of the flow control weir may be disposed at a higher elevation than the crest of the flow control orifice.

As previously mentioned, a first flow control gate and a second flow control gate may have differing crest lengths, as disclosed in the embodiment illustrated in FIG. 9. In another embodiment of the present invention, a third flow control gate 719*c* may have a crest length $L_{1c}$ that is greater than a crest length $L_{1B}$ of a second flow control gate 719*b*, as shown in FIG. 11. In addition, the crest lengths $L_{1B}$, $L_{1c}$ of the second and third flow control gates 719*b*, 719*c* respectively may be greater than the crest length $L_{1A}$ of the first flow control gate 719*a*. For example, the crest 730*c* of the third flow control gate 719*c* may define a crest length of $L_{1c}$ of approximately 10 inches, while the crest 730*b* of the second flow control gate 719*c* may define a crest length of $L_{1B}$ of approximately 9 inches, while the crest 730*a* of the first flow control gate 719*a* may define a crest length of $L_{1A}$ of approximately 7 inches. In some embodiments, the plurality of flow control weirs and/or flow control orifices may define a trapezoidal shaped flow control weir and/or flow control orifice. For example, the crest of the flow control gate may have a length that is less than a nappe of the respective flow control gate.

In addition, each of the respective crests 730*a*, 730*b*, 730*c* of the plurality of flow control gates 719*a*, 719*b*, 719*c* may be disposed at different elevations. For example, the crest 730*c* of the third flow control gate may be disposed at an elevation approximately 2 inches higher than the crest elevation of the first flow control gate and approximately 1 inch higher than the crest elevation of the second flow control gate. Accordingly, the second crest 730*b* may be disposed at an elevation approximately 1 inch higher than the crest elevation of the first flow control gate and approximately 1 inch lower than the crest elevation of the third flow control gate.

As previously mentioned, the plurality of flow control weirs and/or flow control orifices may be configured to provide differing amounts of fluid flow through a respective longitudinal channel. Some embodiments of the present invention may provide for a method for configuring, shaping, sizing, and/or placing a plurality of flow control weirs and/or flow control orifices that may be in fluid communication with a plurality of longitudinal channels respectively. In addition, some embodiments of the present invention may provide for a method for configuring, shaping, sizing, and/or placing a plurality of flow control weirs and/or flow control orifices for increasing the concentration of dissolved oxygen level in the fluid flowing through a plurality of longitudinal channels. For example, according to one embodiment, the amount of fluid flow through a trapezoidal-shaped flow control gate may be defined by the following equation:

$$Q=3.1*L^{1.02}*H^{1.47}+2.48*n*H^{2.47}$$

wherein L equals the length of the flow control gate in feet, H equals the height of the water in feet, n equals tan(0.5*a), wherein a is approximately an included angle (i.e., the total angle between the gate side edges and the vertical axis), as shown in FIG. 17. Specifically, FIG. 17 illustrates ½ of a being defined by the vertical axis and one of the gate side edges and another gate side edge and the vertical axis defining ½a. As such, the included angle a is the total of the angles between the gate side edges and the vertical axis. Accordingly, some embodiments may provide a method for configuring, shaping, sizing, and/or placing a plurality of flow control gates that may be in fluid communication with a plurality of longitudinal channels for increasing the concentration of dissolved oxygen level in the fluid in accordance with the above equation.

In another embodiment, a method may provide for increasing the dissolved oxygen content in a fluid based at least in part on a desired minimum and maximum fluid flow rate. For example, a minimum fluid flow rate and a maximum fluid flow rate may be selected as a design parameter for a particular low profile cascade aerator. In some embodiments, the minimum and maximum flow rates may be based, at least in part, by the location of the cascade aerator, the operator of the cascade aerator, the climate of the cascade aerator locale, the amount of rainfall the cascade aerator locale receives, the surrounding community size for which the cascade aerator provides wastewater treatment, and/or the like. For example, in one embodiment, a desired minimum flow rate may be preselected to be approximately 0.04 million gallons per day and a maximum flow rate may be preselected to be approximately 7.5 million gallons per day. In addition, one embodiment of the present invention may provide a method of selecting a number of longitudinal channels and a number of flow control weirs and/or flow control orifices in fluid communication with each of the longitudinal channels to provide for increasing dissolved oxygen content in the fluid with flow rates being approximately between the minimum and maximum preselected fluid flow rates. For example, a first longitudinal channel may be configured to provide for increasing the dissolved oxygen concentration in the fluid for the minimum preselected flow rate. Further, a second longitudinal channel may be configured to provide for increasing the dissolved oxygen concentration in the fluid at a greater flow rate. In another embodiment, additional longitudinal channels may be configured to provide for increasing the dissolved oxygen concentration in the fluid at the maximum preselected flow rate.

In some embodiments, increasing the dissolved oxygen concentration in a fluid through a longitudinal channel may require the fluid flowing through the longitudinal channel and/or flow control gate to reach a particular height before providing the increased dissolved oxygen concentrations. Accordingly, one embodiment of the present invention may provide a method of determining a number of a plurality of longitudinal channels and determining the percentage of total fluid flow through any of the longitudinal channels so as to obtain the desired dissolved oxygen concentration levels in the total fluid flow. For example, one embodiment may include a method of determining a low profile cascade aerator requires six longitudinal channels to provide for the desired dissolved oxygen concentration for a preselected minimum and maximum fluid flow rate. In addition, the method may further include determining that at least 10% of the total fluid flow rate should travel through a longitudinal channel before the fluid begins to travel through a subsequent longitudinal channel, as shown in Table 1 below.

TABLE 1

| Summary of % Flow in Each Channel | | | | | |
|---|---|---|---|---|---|
| Ch1 % | Ch2 % | Ch3 % | Ch4 % | Ch5 % | Total % |
| 0.00% | 0.00% | 0.00% | 0% | 0% | 0.00% |
| 100.00% | 0.00% | 0.00% | 0.00% | 0.00% | 100.00% |
| 100.00% | 0.00% | 0.00% | 0.00% | 0.00% | 100.00% |
| 100.00% | 0.00% | 0.00% | 0.00% | 0.00% | 100.00% |
| 100.00% | 0.00% | 0.00% | 0.00% | 0.00% | 100.00% |
| 100.00% | 0.00% | 0.00% | 0.00% | 0.00% | 100.00% |
| 100.00% | 0.00% | 0.00% | 0.00% | 0.00% | 100.00% |
| 100.00% | 0.00% | 0.00% | 0.00% | 0.00% | 100.00% |
| 100.00% | 0.00% | 0.00% | 0.00% | 0.00% | 100.00% |
| 100.00% | 0.00% | 0.00% | 0.00% | 0.00% | 100.00% |
| 100.00% | 0.00% | 0.00% | 0.00% | 0.00% | 100.00% |
| 100.00% | 0.00% | 0.00% | 0.00% | 0.00% | 100.00% |
| 100.00% | 0.00% | 0.00% | 0.00% | 0.00% | 100.00% |
| 100.00% | 0.00% | 0.00% | 0.00% | 0.00% | 100.00% |
| 100.00% | 0.00% | 0.00% | 0.00% | 0.00% | 100.00% |
| 100.00% | 0.00% | 0.00% | 0.00% | 0.00% | 100.00% |
| 100.00% | 0.00% | 0.00% | 0.00% | 0.00% | 100.00% |
| 100.00% | 0.00% | 0.00% | 0.00% | 0.00% | 100.00% |
| 100.00% | 0.00% | 0.00% | 0.00% | 0.00% | 100.00% |
| 100.00% | 0.00% | 0.00% | 0.00% | 0.00% | 100.00% |
| 100.00% | 0.00% | 0.00% | 0.00% | 0.00% | 100.00% |
| 100.00% | 0.00% | 0.00% | 0.00% | 0.00% | 100.00% |

TABLE 1-continued

| Summary of % Flow in Each Channel | | | | | |
|---|---|---|---|---|---|
| Ch1 % | Ch2 % | Ch3 % | Ch4 % | Ch5 % | Total % |
| 100.00% | 0.00% | 0.00% | 0.00% | 0.00% | 100.00% |
| 100.00% | 0.00% | 0.00% | 0.00% | 0.00% | 100.00% |
| 100.00% | 0.00% | 0.00% | 0.00% | 0.00% | 100.00% |
| 100.00% | 0.00% | 0.00% | 0.00% | 0.00% | 100.00% |
| 100.00% | 0.00% | 0.00% | 0.00% | 0.00% | 100.00% |
| 100.00% | 0.00% | 0.00% | 0.00% | 0.00% | 100.00% |
| 100.00% | 0.00% | 0.00% | 0.00% | 0.00% | 100.00% |
| 100.00% | 0.00% | 0.00% | 0.00% | 0.00% | 100.00% |
| 99.44% | ***0.56%*** | 0.00% | 0.00% | 0.00% | 100.00% |
| 98.52% | ***1.48%*** | 0.00% | 0.00% | 0.00% | 100.00% |
| 97.46% | ***2.54%*** | 0.00% | 0.00% | 0.00% | 100.00% |
| 96.33% | ***3.67%*** | 0.00% | 0.00% | 0.00% | 100.00% |
| 95.18% | ***4.82%*** | 0.00% | 0.00% | 0.00% | 100.00% |
| 94.02% | ***5.98%*** | 0.00% | 0.00% | 0.00% | 100.00% |
| 92.88% | ***7.12%*** | 0.00% | 0.00% | 0.00% | 100.00% |
| 91.77% | ***8.23%*** | 0.00% | 0.00% | 0.00% | 100.00% |
| 90.69% | ***9.31%*** | 0.00% | 0.00% | 0.00% | 100.00% |
| 89.64% | 10.36% | 0.00% | 0.00% | 0.00% | 100.00% |
| 88.63% | 11.37% | 0.00% | 0.00% | 0.00% | 100.00% |
| 87.66% | 12.34% | 0.00% | 0.00% | 0.00% | 100.00% |
| 86.81% | 13.19% | 0.00% | 0.00% | 0.00% | 100.00% |
| 85.74% | 14.26% | 0.00% | 0.00% | 0.00% | 100.00% |
| 84.69% | 15.31% | 0.00% | 0.00% | 0.00% | 100.00% |
| 83.22% | 16.26% | ***0.52%*** | 0.00% | 0.00% | 100.00% |
| 81.49% | 17.13% | ***1.38%*** | 0.00% | 0.00% | 100.00% |
| 79.65% | 17.94% | ***2.42%*** | 0.00% | 0.00% | 100.00% |
| 77.76% | 18.69% | ***3.55%*** | 0.00% | 0.00% | 100.00% |
| 75.87% | 19.39% | ***4.74%*** | 0.00% | 0.00% | 100.00% |
| 73.99% | 20.04% | ***5.97%*** | 0.00% | 0.00% | 100.00% |
| 72.13% | 20.66% | ***7.21%*** | 0.00% | 0.00% | 100.00% |
| 70.31% | 21.24% | ***8.45%*** | 0.00% | 0.00% | 100.00% |
| 68.54% | 21.78% | ***9.68%*** | 0.00% | 0.00% | 100.00% |
| 66.81% | 22.29% | 10.90% | 0.00% | 0.00% | 100.00% |
| 64.80% | 22.66% | 12.03% | ***0.51%*** | 0.00% | 100.00% |
| 62.65% | 22.92% | 13.09% | ***1.35%*** | 0.00% | 100.00% |
| 60.48% | 23.10% | 14.07% | ***2.34%*** | 0.00% | 100.00% |
| 58.34% | 23.24% | 15.00% | ***3.42%*** | 0.00% | 100.00% |
| 56.26% | 23.34% | 15.86% | ***4.54%*** | 0.00% | 100.00% |
| 54.25% | 23.41% | 16.67% | ***5.67%*** | 0.00% | 100.00% |
| 52.32% | 23.45% | 17.43% | ***6.80%*** | 0.00% | 100.00% |
| 50.47% | 23.47% | 18.14% | ***7.92%*** | 0.00% | 100.00% |
| 48.70% | 23.47% | 18.80% | ***9.02%*** | 0.00% | 100.00% |
| 47.02% | 23.46% | 19.43% | 10.09% | 0.00% | 100.00% |
| 45.18% | 23.32% | 19.91% | 11.07% | ***0.52%*** | 100.00% |
| 43.29% | 23.09% | 20.28% | 11.97% | ***1.37%*** | 100.00% |
| 41.43% | 22.82% | 20.58% | 12.81% | ***2.37%*** | 100.00% |
| 39.64% | 22.53% | 20.82% | 13.57% | ***3.44%*** | 100.00% |
| 37.93% | 22.23% | 21.02% | 14.29% | ***4.54%*** | 100.00% |
| 36.31% | 21.92% | 21.18% | 14.94% | ***5.65%*** | 100.00% |
| 34.78% | 21.61% | 21.31% | 15.55% | ***6.74%*** | 100.00% |
| 33.33% | 21.31% | 21.42% | 16.12% | ***7.82%*** | 100.00% |
| 31.96% | 21.02% | 21.51% | 16.65% | ***8.87%*** | 100.00% |
| 30.68% | 20.73% | 21.58% | 17.13% | ***9.89%*** | 100.00% |
| 29.46% | 20.45% | 21.63% | 17.59% | 10.87% | 100.00% |
| 28.32% | 20.18% | 21.67% | 18.01% | 11.82% | 100.00% |
| 27.25% | 19.91% | 21.70% | 18.41% | 12.73% | 100.00% |
| 26.23% | 19.66% | 21.72% | 18.78% | 13.60% | 100.00% |
| 25.27% | 19.45% | 21.73% | 19.11% | 14.43% | 100.00% |
| 24.42% | 19.02% | 21.79% | 19.49% | 15.28% | 100.00% |
| 23.63% | 18.60% | 21.85% | 19.84% | 16.09% | 100.00% |
| 22.87% | 18.19% | 21.90% | 20.17% | 16.87% | 100.00% |
| 22.16% | 17.79% | 21.94% | 20.49% | 17.62% | 100.00% |
| 21.47% | 17.41% | 21.98% | 20.79% | 18.34% | 100.00% |
| 20.83% | 17.03% | 22.02% | 21.08% | 19.04% | 100.00% |
| 20.21% | 16.67% | 22.05% | 21.35% | 19.72% | 100.00% |
| 19.63% | 16.32% | 22.08% | 21.61% | 20.37% | 100.00% |
| 19.07% | 15.97% | 22.11% | 21.86% | 20.99% | 100.00% |
| 18.54% | 15.64% | 22.13% | 22.09% | 21.59% | 100.00% |
| 18.03% | 15.32% | 22.15% | 22.32% | 22.18% | 100.00% |
| 17.55% | 15.01% | 22.17% | 22.54% | 22.74% | 100.00% |
| 17.08% | 14.71% | 22.19% | 22.74% | 23.28% | 100.00% |
| 16.64% | 14.41% | 22.20% | 22.94% | 23.80% | 100.00% |
| 16.21% | 14.13% | 22.22% | 23.13% | 24.31% | 100.00% |
| 15.81% | 13.85% | 22.23% | 23.32% | 24.80% | 100.00% |
| 15.42% | 13.59% | 22.24% | 23.49% | 25.27% | 100.00% |
| 15.04% | 13.33% | 22.25% | 23.66% | 25.73% | 100.00% |

TABLE 1-continued

| Summary of % Flow in Each Channel | | | | | |
|---|---|---|---|---|---|
| Ch1 % | Ch2 % | Ch3 % | Ch4 % | Ch5 % | Total % |
| 14.68% | 13.07% | 22.25% | 23.82% | 26.17% | 100.00% |
| 14.34% | 12.83% | 22.26% | 23.98% | 26.60% | 100.00% |
| 14.00% | 12.59% | 22.27% | 24.13% | 27.01% | 100.00% |
| 13.70% | 12.37% | 22.21% | 24.29% | 27.44% | 100.00% |
| 13.42% | 12.18% | 22.02% | 24.49% | 27.89% | 100.00% |
| 13.16% | 11.99% | 21.82% | 24.69% | 28.34% | 100.00% |
| 12.90% | 11.81% | 21.62% | 24.88% | 28.79% | 100.00% |
| 12.66% | 11.63% | 21.43% | 25.07% | 29.22% | 100.00% |
| 12.42% | 11.46% | 21.23% | 25.25% | 29.64% | 100.00% |
| 12.19% | 11.29% | 21.03% | 25.43% | 30.06% | 100.00% |
| 11.97% | 11.12% | 20.83% | 25.61% | 30.46% | 100.00% |
| 11.76% | 10.96% | 20.63% | 25.79% | 30.86% | 100.00% |
| 11.55% | 10.81% | 20.43% | 25.96% | 31.25% | 100.00% |
| 11.35% | 10.66% | 20.24% | 26.13% | 31.63% | 100.00% |
| 11.15% | 10.51% | 20.04% | 26.29% | 32.01% | 100.00% |
| 10.97% | 10.36% | 19.84% | 26.45% | 32.38% | 100.00% |
| 10.78% | 10.22% | 19.65% | 26.61% | 32.74% | 100.00% |
| 10.60% | 10.08% | 19.46% | 26.77% | 33.09% | 100.00% |
| 10.43% | 9.95% | 19.27% | 26.92% | 33.44% | 100.00% |
| 10.26% | 9.81% | 19.08% | 27.07% | 33.78% | 100.00% |
| 10.10% | 9.68% | 18.89% | 27.21% | 34.11% | 100.00% |
| 9.97% | 9.59% | 18.76% | 27.14% | 34.54% | 100.00% |
| 9.84% | 9.49% | 18.62% | 27.08% | 34.96% | 100.00% |
| 9.72% | 9.39% | 18.49% | 27.01% | 35.38% | 100.00% |
| 9.60% | 9.30% | 18.36% | 26.94% | 35.80% | 100.00% |
| 9.48% | 9.21% | 18.23% | 26.86% | 36.21% | 100.00% |
| 9.37% | 9.12% | 18.11% | 26.78% | 36.62% | 100.00% |
| 9.26% | 9.03% | 17.98% | 26.70% | 37.03% | 100.00% |
| 9.15% | 8.95% | 17.86% | 26.61% | 37.44% | 100.00% |
| 9.04% | 8.86% | 17.73% | 26.52% | 37.84% | 100.00% |
| 8.94% | 8.78% | 17.61% | 26.42% | 38.24% | 100.00% |
| 8.84% | 8.70% | 17.49% | 26.33% | 38.64% | 100.00% |

In this respect, a first longitudinal channel may experience 100% of the fluid flow at a preselected minimum flow rate. Accordingly, the first longitudinal channel may be configured to provide the increased dissolved oxygen concentration in the fluid as the fluid flows through the first longitudinal channel. As the total flow rate increases, a second longitudinal channel may be configured to receive a portion of the total fluid flow therethrough. Further, as the flow rate continues to increase, a subsequent third longitudinal channel may be configured to receive a portion of the total fluid flow therethrough. According to one embodiment, a method is provided to configure the flow control weirs and/or flow control orifices, which are in fluid communication with the respective plurality of longitudinal channels, such that for example, the third longitudinal channel does not receive a fluid flow therethrough until the second longitudinal channel receives at least 10% or more of the total fluid flow rate therethrough, such as illustrated by the bold and italicized numbers in the embodiment of Table 1. An embodiment of the present invention advantageously provides the mixing of a first percentage of fluid flowing through a first longitudinal channel, wherein the first fluid flow flowing through the first longitudinal channel receives the desired manipulation, treatment, flow characteristics, and/or the like to increase the dissolved oxygen concentration, with a second percentage of fluid flowing through a second longitudinal channel so as to obtain a total fluid flowing through all of the longitudinal channels having a total desired increased dissolved oxygen concentration. Although the 10% fluid flow rate threshold has been selected as the desired threshold before diverting fluid to a subsequent longitudinal channel for providing a desired total fluid flow having an increased dissolved oxygen concentration, one of ordinary skill in the art may appreciate that a percentage may be selected in accordance with the number of longitudinal channels.

In another embodiment, the fluid flow rate through a longitudinal channel may require the fluid reaching a particular height before providing increased dissolved oxygen concentrations. Accordingly, one embodiment of the present invention may provide a method of determining the number of plurality of longitudinal channels and determining the height of the fluid flowing through any of the longitudinal channels so as to obtain the desired dissolved oxygen concentration levels in the total fluid flow. For example, one embodiment may include a method of determining a low profile cascade aerator requires six longitudinal channels to provide for the desired dissolved oxygen concentration for a preselected minimum and maximum fluid flow rate. In addition, the method may further include determining that the fluid flowing through a longitudinal channel should be at least 1 inch or higher before fluid begins to travel through a subsequent longitudinal channel, as shown in Table 2 below.

TABLE 2

| Entry | Summary of H Values in Each Channel | | | | |
|---|---|---|---|---|---|
| H (in) | Ch1 H (in) | Ch2 H (in) | Ch3 H (in) | Ch4 H (in) | Ch5 H (in) |
| 1.0 | 0.0 | 0.0 | 0.0 | 0.0 | 0.0 |
| 1.1 | ***0.1*** | 0.0 | 0.0 | 0.0 | 0.0 |
| 1.2 | ***0.2*** | 0.0 | 0.0 | 0.0 | 0.0 |
| 1.3 | ***0.3*** | 0.0 | 0.0 | 0.0 | 0.0 |
| 1.4 | ***0.4*** | 0.0 | 0.0 | 0.0 | 0.0 |
| 1.5 | ***0.5*** | 0.0 | 0.0 | 0.0 | 0.0 |
| 1.6 | ***0.6*** | 0.0 | 0.0 | 0.0 | 0.0 |
| 1.7 | ***0.7*** | 0.0 | 0.0 | 0.0 | 0.0 |
| 1.8 | ***0.8*** | 0.0 | 0.0 | 0.0 | 0.0 |
| 1.9 | ***0.9*** | 0.0 | 0.0 | 0.0 | 0.0 |
| 2.0 | ***1.0*** | 0.0 | 0.0 | 0.0 | 0.0 |
| 2.1 | 1.1 | 0.0 | 0.0 | 0.0 | 0.0 |
| 2.2 | 1.2 | 0.0 | 0.0 | 0.0 | 0.0 |
| 2.3 | 1.3 | 0.0 | 0.0 | 0.0 | 0.0 |
| 2.4 | 1.4 | 0.0 | 0.0 | 0.0 | 0.0 |
| 2.5 | 1.5 | 0.0 | 0.0 | 0.0 | 0.0 |
| 2.6 | 1.6 | 0.0 | 0.0 | 0.0 | 0.0 |
| 2.7 | 1.7 | 0.0 | 0.0 | 0.0 | 0.0 |
| 2.8 | 1.8 | 0.0 | 0.0 | 0.0 | 0.0 |
| 2.9 | 1.9 | 0.0 | 0.0 | 0.0 | 0.0 |
| 3.0 | 2.0 | 0.0 | 0.0 | 0.0 | 0.0 |
| 3.1 | 2.1 | 0.0 | 0.0 | 0.0 | 0.0 |
| 3.2 | 2.2 | 0.0 | 0.0 | 0.0 | 0.0 |
| 3.3 | 2.3 | 0.0 | 0.0 | 0.0 | 0.0 |
| 3.4 | 2.4 | 0.0 | 0.0 | 0.0 | 0.0 |
| 3.5 | 2.5 | 0.0 | 0.0 | 0.0 | 0.0 |
| 3.6 | 2.6 | 0.0 | 0.0 | 0.0 | 0.0 |
| 3.7 | 2.7 | 0.0 | 0.0 | 0.0 | 0.0 |
| 3.8 | 2.8 | 0.0 | 0.0 | 0.0 | 0.0 |
| 3.9 | 2.9 | 0.0 | 0.0 | 0.0 | 0.0 |
| 4.0 | 3.0 | 0.0 | 0.0 | 0.0 | 0.0 |
| 4.1 | 3.1 | ***0.1*** | 0.0 | 0.0 | 0.0 |
| 4.2 | 3.2 | ***0.2*** | 0.0 | 0.0 | 0.0 |
| 4.3 | 3.3 | ***0.3*** | 0.0 | 0.0 | 0.0 |
| 4.4 | 3.4 | ***0.4*** | 0.0 | 0.0 | 0.0 |
| 4.5 | 3.5 | ***0.5*** | 0.0 | 0.0 | 0.0 |
| 4.6 | 3.6 | ***0.6*** | 0.0 | 0.0 | 0.0 |
| 4.7 | 3.7 | ***0.7*** | 0.0 | 0.0 | 0.0 |
| 4.8 | 3.8 | ***0.8*** | 0.0 | 0.0 | 0.0 |
| 4.9 | 3.9 | ***0.9*** | 0.0 | 0.0 | 0.0 |
| 5.0 | 4.0 | ***1.0*** | 0.0 | 0.0 | 0.0 |
| 5.1 | 4.1 | 1.1 | 0.0 | 0.0 | 0.0 |
| 5.2 | 4.2 | 1.2 | 0.0 | 0.0 | 0.0 |
| 5.3 | 4.3 | 1.3 | 0.0 | 0.0 | 0.0 |
| 5.4 | 4.4 | 1.4 | 0.0 | 0.0 | 0.0 |
| 5.5 | 4.5 | 1.5 | 0.0 | 0.0 | 0.0 |
| 5.6 | 4.6 | 1.6 | ***0.1*** | 0.0 | 0.0 |
| 5.7 | 4.7 | 1.7 | ***0.2*** | 0.0 | 0.0 |
| 5.8 | 4.8 | 1.8 | ***0.3*** | 0.0 | 0.0 |
| 5.9 | 4.9 | 1.9 | ***0.4*** | 0.0 | 0.0 |
| 6.0 | 5.0 | 2.0 | ***0.5*** | 0.0 | 0.0 |
| 6.1 | 5.1 | 2.1 | ***0.6*** | 0.0 | 0.0 |
| 6.2 | 5.2 | 2.2 | ***0.7*** | 0.0 | 0.0 |

TABLE 2-continued

| Entry | Summary of H Values in Each Channel | | | | |
|---|---|---|---|---|---|
| H (in) | Ch1 H (in) | Ch2 H (in) | Ch3 H (in) | Ch4 H (in) | Ch5 H (in) |
| 6.3 | 5.3 | 2.3 | ***0.8*** | 0.0 | 0.0 |
| 6.4 | 5.4 | 2.4 | ***0.9*** | 0.0 | 0.0 |
| 6.5 | 5.5 | 2.5 | ***1.0*** | 0.0 | 0.0 |
| 6.6 | 5.6 | 2.6 | 1.1 | ***0.1*** | 0.0 |
| 6.7 | 5.7 | 2.7 | 1.2 | ***0.2*** | 0.0 |
| 6.8 | 5.8 | 2.8 | 1.3 | ***0.3*** | 0.0 |
| 6.9 | 5.9 | 2.9 | 1.4 | ***0.4*** | 0.0 |
| 7.0 | 6.0 | 3.0 | 1.5 | ***0.5*** | 0.0 |
| 7.1 | 6.1 | 3.1 | 1.6 | ***0.6*** | 0.0 |
| 7.2 | 6.2 | 3.2 | 1.7 | ***0.7*** | 0.0 |
| 7.3 | 6.3 | 3.3 | 1.8 | ***0.8*** | 0.0 |
| 7.4 | 6.4 | 3.4 | 1.9 | ***0.9*** | 0.0 |
| 7.5 | 6.5 | 3.5 | 2.0 | ***1.0*** | 0.0 |
| 7.6 | 6.6 | 3.6 | 2.1 | 1.1 | ***0.1*** |
| 7.7 | 6.7 | 3.7 | 2.2 | 1.2 | ***0.2*** |
| 7.8 | 6.8 | 3.8 | 2.3 | 1.3 | ***0.3*** |
| 7.9 | 6.9 | 3.9 | 2.4 | 1.4 | ***0.4*** |
| 8.0 | 7.0 | 4.0 | 2.5 | 1.5 | ***0.5*** |
| 8.1 | 7.1 | 4.1 | 2.6 | 1.6 | ***0.6*** |
| 8.2 | 7.2 | 4.2 | 2.7 | 1.7 | ***0.7*** |
| 8.3 | 7.3 | 4.3 | 2.8 | 1.8 | ***0.8*** |
| 8.4 | 7.4 | 4.4 | 2.9 | 1.9 | ***0.9*** |
| 8.5 | 7.5 | 4.5 | 3.0 | 2.0 | ***1.0*** |
| 8.6 | 7.6 | 4.6 | 3.1 | 2.1 | 1.1 |
| 8.7 | 7.7 | 4.7 | 3.2 | 2.2 | 1.2 |
| 8.8 | 7.8 | 4.8 | 3.3 | 2.3 | 1.3 |
| 8.9 | 7.9 | 4.9 | 3.4 | 2.4 | 1.4 |
| 9.0 | 8.0 | 5.0 | 3.5 | 2.5 | 1.5 |
| 9.1 | 8.1 | 5.1 | 3.6 | 2.6 | 1.6 |
| 9.2 | 8.2 | 5.2 | 3.7 | 2.7 | 1.7 |
| 9.3 | 8.3 | 5.3 | 3.8 | 2.8 | 1.8 |
| 9.4 | 8.4 | 5.4 | 3.9 | 2.9 | 1.9 |
| 9.5 | 8.5 | 5.5 | 4.0 | 3.0 | 2.0 |
| 9.6 | 8.6 | 5.6 | 4.1 | 3.1 | 2.1 |
| 9.7 | 8.7 | 5.7 | 4.2 | 3.2 | 2.2 |
| 9.8 | 8.8 | 5.8 | 4.3 | 3.3 | 2.3 |
| 9.9 | 8.9 | 5.9 | 4.4 | 3.4 | 2.4 |
| 10.0 | 9.0 | 6.0 | 4.5 | 3.5 | 2.5 |
| 10.1 | 9.1 | 6.1 | 4.6 | 3.6 | 2.6 |
| 10.2 | 9.2 | 6.2 | 4.7 | 3.7 | 2.7 |
| 10.3 | 9.3 | 6.3 | 4.8 | 3.8 | 2.8 |
| 10.4 | 9.4 | 6.4 | 4.9 | 3.9 | 2.9 |
| 10.5 | 9.5 | 6.5 | 5.0 | 4.0 | 3.0 |
| 10.6 | 9.6 | 6.6 | 5.1 | 4.1 | 3.1 |
| 10.7 | 9.7 | 6.7 | 5.2 | 4.2 | 3.2 |
| 10.8 | 9.8 | 6.8 | 5.3 | 4.3 | 3.3 |
| 10.9 | 9.9 | 6.9 | 5.4 | 4.4 | 3.4 |
| 11.0 | 10.0 | 7.0 | 5.5 | 4.5 | 3.5 |
| 11.1 | 10.1 | 7.1 | 5.6 | 4.6 | 3.6 |
| 11.2 | 10.2 | 7.2 | 5.7 | 4.7 | 3.7 |
| 11.3 | 10.3 | 7.3 | 5.8 | 4.8 | 3.8 |
| 11.4 | 10.4 | 7.4 | 5.9 | 4.9 | 3.9 |
| 11.5 | 10.5 | 7.5 | 6.0 | 5.0 | 4.0 |
| 11.6 | 10.6 | 7.6 | 6.1 | 5.1 | 4.1 |
| 11.7 | 10.7 | 7.7 | 6.2 | 5.2 | 4.2 |
| 11.8 | 10.8 | 7.8 | 6.3 | 5.3 | 4.3 |
| 11.9 | 10.9 | 7.9 | 6.4 | 5.4 | 4.4 |
| 12.0 | 11.0 | 8.0 | 6.5 | 5.5 | 4.5 |
| 12.1 | 11.1 | 8.1 | 6.6 | 5.6 | 4.6 |
| 12.2 | 11.2 | 8.2 | 6.7 | 5.7 | 4.7 |
| 12.3 | 11.3 | 8.3 | 6.8 | 5.8 | 4.8 |
| 12.4 | 11.4 | 8.4 | 6.9 | 5.9 | 4.9 |
| 12.5 | 11.5 | 8.5 | 7.0 | 6.0 | 5.0 |
| 12.6 | 11.6 | 8.6 | 7.1 | 6.1 | 5.1 |
| 12.7 | 11.7 | 8.7 | 7.2 | 6.2 | 5.2 |
| 12.8 | 11.8 | 8.8 | 7.3 | 6.3 | 5.3 |
| 12.9 | 11.9 | 8.9 | 7.4 | 6.4 | 5.4 |
| 13.0 | 12.0 | 9.0 | 7.5 | 6.5 | 5.5 |
| 13.1 | 12.1 | 9.1 | 7.6 | 6.6 | 5.6 |
| 13.2 | 12.2 | 9.2 | 7.7 | 6.7 | 5.7 |
| 13.3 | 12.3 | 9.3 | 7.8 | 6.8 | 5.8 |
| 13.4 | 12.4 | 9.4 | 7.9 | 6.9 | 5.9 |
| 13.5 | 12.5 | 9.5 | 8.0 | 7.0 | 6.0 |
| 13.6 | 12.6 | 9.6 | 8.1 | 7.1 | 6.1 |
| 13.7 | 12.7 | 9.7 | 8.2 | 7.2 | 6.2 |
| 13.8 | 12.8 | 9.8 | 8.3 | 7.3 | 6.3 |

TABLE 2-continued

| Entry | Summary of H Values in Each Channel | | | | |
|---|---|---|---|---|---|
| H (in) | Ch1 H (in) | Ch2 H (in) | Ch3 H (in) | Ch4 H (in) | Ch5 H (in) |
| 13.9 | 12.9 | 9.9 | 8.4 | 7.4 | 6.4 |
| 14.0 | 13.0 | 10.0 | 8.5 | 7.5 | 6.5 |

In this respect, a first longitudinal channel may experience 100% of the fluid flow at the preselected minimum flow rate. Accordingly, the first longitudinal channel may be configured to provide the increased dissolved oxygen concentration in the fluid as the fluid flows through the first longitudinal channel. Accordingly, the first flow control gate configured to be in fluid communication with the first longitudinal channel may be shaped and disposed at a particular height to provide for the increased dissolved oxygen concentration in the fluid as the fluid flows through the first longitudinal channel at a preselected minimum flow rate. As the total flow rate increases, a second longitudinal channel may be configured to receive a portion of the total fluid flow therethrough. Further, as the flow rate continues to increase, a subsequent longitudinal channel may be configured to receive a portion of the total fluid flow therethrough. According to one embodiment of the present invention, a method is provided to configure the flow control weirs and/or flow control orifices, which are in fluid communication with the respective plurality of longitudinal channels, such that a subsequent longitudinal channel does not receive a fluid flow therethrough until the preceding longitudinal channel has received a fluid flow therethrough that provides a fluid height of at least 1 inch, such as illustrated by the bold and italicized numbers in the embodiment of Table 2. Accordingly, some embodiments of the present invention advantageously provide for the mixing of a first fluid flow flowing through a first longitudinal channel, wherein the first fluid flow flowing through the first longitudinal channel receives the desired manipulation, treatment, flow characteristics, and/or the like to increase the dissolved oxygen concentration, with a second fluid flow flowing through a second longitudinal channel, so as to obtain a total fluid flow flowing through all of the longitudinal channels, wherein the total fluid flow has a total desired increased dissolved oxygen concentration. Although the 1 inch fluid flow height threshold has been selected as the desired threshold before diverting fluid to a subsequent longitudinal channel for providing a desired total fluid flow having an increased dissolved oxygen concentration, one of ordinary skill in the art may appreciated that a number of heights may be selected in accordance with the number of longitudinal channels.

FIG. 18 illustrates a graph detailing the fluid flow rates through each of the longitudinal channels according to one embodiment. Specifically, FIG. 18 illustrates the amount of fluid flow through each of the longitudinal channels as the height of the fluid at the entry chamber increases. As illustrated in FIG. 18, the total fluid flow amount is equivalent to the fluid flow amount in the first longitudinal channel until the fluid entry height reaches approximately 4.1 inches. In other words, FIG. 18 illustrates the amount of fluid flowing through each of the longitudinal channels in accordance with the data disclosed in Table 2, which illustrates the height of the water flowing through each of the longitudinal channels at a given fluid entry height. FIG. 4 illustrates an example embodiment, wherein the amount of fluid flow through a subsequent longitudinal channel is dependent on when an entry fluid height reaches the particular height of the flow control gate for the respective longitudinal channel. In addition, FIGS. 8-11 illustrate that a flow control gate for a first respective longitudinal channel may be disposed at an elevation lower than a flow control gate for a second longitudinal channel, thereby providing for a first fluid flow through a first longitudinal channel only until the entry fluid height is greater than the height of the flow control gate in fluid communication with the second longitudinal channel.

According to some embodiments, a flow control gate 19 may further include an aeration plate 18 configured to optimize the fluid flow and/or the concentration of dissolved oxygen within the fluid. FIG. 4 illustrates one embodiment wherein a flow control gate 19 may include an aeration plate 18 configured to increase the dissolved oxygen concentration in the fluid flowing therethrough. For example, a low profile cascade aerator may include at least one flow control gate and at least one transverse baffle and a plurality of aeration plates configured to provide for increasing the dissolved oxygen concentration for a fluid flowing therethrough. As discussed in various embodiments herein, the at least one flow control gate and at least one transverse baffle and a plurality of aeration plates may be configured to provide for a similar head at a lower flow rate when compared to a flow rate of a known flow control gate and/or aeration plates, and may be further configured to provide for a similar head at a higher flow rate when compared to the same flow rate for a known flow control gate and/or aeration plates. According to some embodiments, each of the longitudinal channels 16 may further include a plurality of transverse baffles 17 and a plurality of aeration plates 18, as illustrated in FIGS. 1-3. The plurality of transverse low head aeration baffles 17 provide for fluid velocity and pressure changes as the fluid flows over the transverse baffles disposed along a transverse direction to the fluid flow direction in each of the longitudinal channels 16. In some embodiments, the baffles 17 may be spaced approximately 24 inches apart along the longitudinal channels 16.

FIG. 16 illustrates a transverse baffle 17 and a plurality of aeration plates 18 according to one embodiment of the present invention. According to one embodiment, the plurality of aeration plates 18 may include a plurality of longitudinal edges 18'. The plurality of longitudinal edges 18' may extend vertically from a top horizontal edge 17' of the transverse baffle 17. In some embodiments, the plurality of longitudinal edges 18' may be orthogonal to the top horizontal edge 17' of the transverse baffle 17. The plurality of longitudinal edges 18' and the top horizontal edge 17' of the transverse baffle 17 may define an angle greater than 90°. For example, the plurality of longitudinal edges 18' and the top horizontal edge 17' of the transverse baffle 17 may define an angle of approximately 95°. The trapezoidal shaped opening defined by the top horizontal edge 17' and the plurality of longitudinal edges 18' may provide for a similar head height at a lower flow rate when compared to the flow rate for known aeration plates. In addition, the trapezoidal shaped opening defined by the top horizontal edge 17' and the plurality of longitudinal edges 18' may provide for a similar head for a similar higher flow rate when compared to known aeration plates.

According to some embodiments, a transverse baffle 17 and a plurality of aeration plates 18 may define a plurality of crests 30*a*, 30*b*, 30*c*, 30*d* and nappes 32*a*, 32*b*, 32*c*, 32*d*, as shown in FIG. 16. In addition, the plurality of crests 30*a*, 30*b*, 30*c*, 30*d* and nappes 32*a*, 32*b*, 32*c*, 32*d* may define a plurality of crest lengths and a plurality of nappe lengths respectively. In some embodiments, the plurality of nappe lengths may be equal to or greater than the plurality of crest lengths, as illustrated in FIG. 16. According to some embodiments, a second crest 30*b* defined between two aeration plates 18 may define a crest length of approximately 3.5, 4 or 4.5 inches. As illustrated in FIG. 16, the second crest 30*b* may define a crest length of approximately 4.5 inches. In addition, a corresponding nappe 32*b* defined by the height of the fluid 12 exiting over the transverse baffle 17 may, at a minimum, define a nappe length of approximately 4.5 inches when the elevation between the crest 30*b* and the nappe 32*b* is approximately zero. In some embodiments, a flow control gate may be configured to provide for the prevention of a fluid overflowing in a longitudinal channel and flowing at a height greater than the height of the aeration plate 18. Accordingly, a flow control gate may be configured such that the nappe height of the nappe 32*a*, 32*b*, 32*c*, 32*d* is not greater than the height of the aeration plates 18. As shown in FIG. 16, in an instance in which the nappe 32*b* may be defined between the longitudinal edges 18' of a plurality of aeration plates 18 and the height of the fluid 12 exiting over the transverse baffle 17, the nappe may define a nappe length of approximately 5 inches.

According to some embodiments, at least one aeration plate 18 may be coupled to a flow control gate 19 to optimize the concentration of dissolved oxygen within the fluid at a given flow rate. In addition, embodiments of the present invention may advantageously provide for a greater nappe height at a lower flow rate. Further, embodiments of the present invention may advantageously provide for a similar nappe height at higher flow rates. In addition, some embodiments may advantageously provide for a method of designing a cascade aerator to provide an increased dissolved oxygen concentration based at least on a preselected minimum and maximum fluid flow rate.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A cascade aerator for increasing the level of dissolved oxygen flowing therethrough comprising:

a plurality of longitudinal channels configured to receive a fluid therethrough;

a plurality of flow control gates, wherein a first number of flow control gates are in fluid communication with a first longitudinal channel and a second number of flow control gates are in fluid communication with a second longitudinal channel, wherein the first number of flow control gates define a crest height that is lower, along a vertical direction, than a crest height defined by the second number of flow control gates;

a plurality of low head baffles extending from respective base surfaces of the first and second longitudinal channels; and a plurality of aeration plates extending from the plurality of low head baffles, wherein the plurality of aeration plates extend from low head baffles to define a plurality of openings configured to allow the fluid to flow therethrough, wherein each opening defines a baffle crest length defined proximate a crest of the low head baffle, and a baffle nappe length defined proximate a second height above the crest of the low head baffle, wherein the baffle nappe length is greater than the baffle crest length.

2. The cascade aerator of claim 1, wherein at least one of the flow control gates defines a flow control orifice.

3. The cascade aerator of claim 2, wherein the flow control orifice is configured to be completely submerged when the fluid flowing through the first and second longitudinal channels exceeds a predetermined threshold flow rate.

4. The cascade aerator of claim 1, wherein at least one of the flow control gates defines a flow control weir.

5. The cascade aerator of claim 1, wherein the plurality of flow control gates define a crest length defined proximate a crest of the flow control gate, and a nappe length defined proximate a first height above the crest, wherein the nappe length is greater than the crest length.

6. The cascade aerator of claim 5, wherein a crest length of the second number of flow control gates is greater than a crest length of the first number of flow control gates.

7. The cascade aerator of claim 1, wherein the flow control gates are disposed at a first end of the longitudinal channels to control flow of the fluid through the longitudinal channels.

8. The cascade aerator of claim 1, wherein at least one of a height of the first flow control gates and a height of the second flow control gates is adjustable.

9. The cascade aerator of claim 1, wherein at least one of the flow control gates is trapezoidal in shape.

10. The cascade aerator of claim 1, wherein the longitudinal channels are sloped from a first end to a second end such that the first and second longitudinal channels are configured to convey the fluid towards the second end via gravity.

11. The cascade aerator of claim 1, wherein at least one flow control gate further comprises at least one aeration plate projecting substantially upward into the at least one flow control gate.

12. The cascade aerator of claim 1, wherein the second number of flow control gates are structured to define a flow control height so as to encourage the fluid to enter the second longitudinal channel when at least 10% of a total flow rate is received by the first longitudinal channel.

13. The cascade aerator of claim 1, wherein the second number of flow control gates are structured to define a flow control height so as to encourage the fluid to enter the second longitudinal channel when a height of fluid flowing through the first number of flow control gates is at least one inch, wherein the height of fluid is defined as a vertical distance between a crest of the flow control gate and a top of the fluid.

14. A cascade aerator for increasing the level of dissolved oxygen flowing therethrough comprising:

a plurality of longitudinal channels configured to receive a fluid therethrough;

a plurality of flow control gates, wherein a first number of flow control gates are in fluid communication with a first longitudinal channel and a second number of flow control gates are in fluid communication with a second longitudinal channel, wherein the plurality of flow control gates define a crest length defined proximate a crest of the flow control gate, and a nappe length defined proximate a first height above the crest, wherein the nappe length is greater than the crest length;

a plurality of low head baffles extending from respective base surfaces of the first and second longitudinal channels; and a plurality of aeration plates extending from the plurality of low head baffles, wherein the plurality of aeration plates extend from low head baffles to define a plurality of openings configured to allow the fluid to flow therethrough, wherein each opening defines a baffle crest length defined proximate a crest of the low head baffle, and a baffle nappe length defined proximate a second height above the crest of the low head baffle, wherein the baffle nappe length is greater than the baffle crest length.

15. The cascade aerator of claim 14, wherein at least one of the flow control gates defines a flow control orifice.

16. The cascade aerator of claim 15, wherein the flow control orifice is configured to be completely submerged when the fluid flowing through the first and second longitudinal channels exceeds a predetermined threshold flow rate.

17. The cascade aerator of claim 14, wherein at least one of the flow control gates defines a flow control weir.

18. The cascade aerator of claim 14, wherein a crest length of the second number of flow control gates is greater than a crest length of the first number of flow control gates.

19. The cascade aerator of claim 14, wherein the first number of flow control gates define a crest height that is lower, along a vertical direction, than a crest height defined by the second number of flow control gates.

20. The cascade aerator of claim 14, wherein a height of the second number of flow control gates are structured to define a flow control height so as to encourage the fluid to enter the second longitudinal channel when at least 10% of a total flow rate is received by the first longitudinal channel.

21. The cascade aerator of claim 14, wherein the second number of flow control gates are structured to define a flow control height so as to encourage the fluid to enter the second longitudinal channel when a height of fluid flowing through the first number of flow control gates is at least one inch, wherein the height of fluid is defined as a vertical distance between a crest of the flow control gate and a top of the fluid.

22. The cascade aerator of claim 14, wherein at least one of the flow control gates is trapezoidal in shape.

23. The cascade aerator of claim 14, wherein the longitudinal channels are sloped from a first end to a second end such that the first and second longitudinal channels are configured to convey the fluid towards the second end via gravity.

24. The cascade aerator of claim 14, wherein each of the at least one flow control gates further comprises at least one aerator plate projecting substantially upward into the at least one flow control gate.

25. A cascade aerator for increasing the level of dissolved oxygen flowing therethrough comprising:

a plurality of low head baffles extending from respective base surfaces of a first longitudinal channel and a second longitudinal channel; and a plurality of aeration plates extending from the plurality of low head baffles, wherein the plurality of aeration plates extend from low head baffles to define a plurality of openings configured to allow the fluid to flow therethrough, wherein each opening defines a baffle crest length defined proximate a crest of the low head baffle, and a baffle nappe length defined proximate a second height above the crest of the low head baffle, wherein the baffle nappe length is greater than the baffle crest length.

26. The cascade aerator of claim 25, further comprising:

a plurality of flow control gates, wherein a first number of flow control gates are in fluid communication with the first longitudinal channel and a second number of flow control gates are in fluid communication with the second longitudinal channel.

27. The cascade aerator of claim 26, wherein the first number of flow control gates define a crest height that is lower, along a vertical direction, than a crest height defined by the second number of flow control gates.

28. The cascade aerator of claim 26, wherein the plurality of flow control gates define a crest length defined proximate a crest of the flow control gate, and a nappe length defined proximate a first height above the crest, wherein the nappe length is greater than the crest length.

* * * * *